US008533890B2

(12) United States Patent
Pannell

(10) Patent No.: US 8,533,890 B2
(45) Date of Patent: Sep. 17, 2013

(54) ENHANCED SWEEPING SYSTEMS

(76) Inventor: Shane D. Pannell, Maricopa, AZ (US)

( * ) Notice: Subject to any disclaimer, the term of this patent is extended or adjusted under 35 U.S.C. 154(b) by 41 days.

(21) Appl. No.: 13/159,308

(22) Filed: Jun. 13, 2011

(65) Prior Publication Data

US 2012/0030889 A1 Feb. 9, 2012

Related U.S. Application Data

(63) Continuation-in-part of application No. 12/851,496, filed on Aug. 5, 2010, now abandoned.

(51) Int. Cl.

| | |
|---|---|
| ***A47L 13/00*** | (2006.01) |
| ***A47L 23/04*** | (2006.01) |
| ***E04F 21/16*** | (2006.01) |

(52) U.S. Cl.

USPC ..... 15/111; 15/143.1; 15/144.4; 15/236.01; 16/427; 16/429

(58) Field of Classification Search

USPC ..... 15/111, 236.01, 144.4, 143.1; 16/429, 16/427

See application file for complete search history.

(56) References Cited

U.S. PATENT DOCUMENTS

| | | | | |
|---|---|---|---|---|
| 1,309,599 | A | 7/1919 | Seaboldt et al. | |
| 1,610,657 | A | 12/1926 | Burgee | |
| 2,163,979 | A | 6/1939 | Judson | |
| 2,533,838 | A | 12/1950 | Ranft | |
| 2,535,253 | A * | 12/1950 | Anderson | 30/128 |
| 2,816,305 | A | 12/1957 | Kravitt | |
| 3,084,369 | A | 4/1963 | Hawkins | |
| 3,153,252 | A * | 10/1964 | Ricciardi | 15/144.4 |
| 3,733,636 | A | 5/1973 | Osadsky | |
| 5,664,279 | A * | 9/1997 | Vosbikian | 15/175 |
| 5,983,455 | A * | 11/1999 | Polzin et al. | 16/429 |
| 6,311,368 | B1 | 11/2001 | Sartori | |
| 6,606,756 | B2 | 8/2003 | Fernandez | |
| 2003/0163884 | A1 | 9/2003 | Weihrauch | |
| 2005/0132517 | A1 | 6/2005 | Weckemann et al. | |

FOREIGN PATENT DOCUMENTS

| | | | |
|---|---|---|---|
| EP | 1050237 | A2 | 11/2000 |
| JP | 11-137497 | A | 5/1999 |
| JP | 2002-125902 | A | 5/2002 |
| WO | WO 95/29624 | A1 | 11/1995 |

* cited by examiner

*Primary Examiner* — Brian Glessner
*Assistant Examiner* — Brian D Mattei
(74) *Attorney, Agent, or Firm* — Thomas W. Galvani, P.C.; Thomas W. Galvani

(57) ABSTRACT

This invention relates to providing a sweeping system incorporating at least one user-deployable scraper feature within a sweeping apparatus to assist in removing dried-on materials from at least one floor surface. The scraper feature is preferably spring tensioned within at least one housing and deployed through use of a manual extension of telescoping cylinders. Further featured is a rotation blocking mechanism to prevent rotation of the scraper while scraping.

15 Claims, 13 Drawing Sheets

ENHANCED SWEEPING SYSTEMS

CROSS-REFERENCE TO RELATED APPLICATION

The present application is a continuation-in-part of, and is related to and claims priority from, application Ser. No. 12/851,496, filed Aug. 5, 2010, entitled "ENHANCED SWEEPING SYSTEMS", the contents of which are incorporated herein by this reference and are not admitted to be prior art with respect to the present invention by the mention in this cross-reference section.

BACKGROUND

This invention relates to providing a system for enhanced sweeping systems. More particularly, this invention relates to providing a sweeping system incorporating at least one user-deployable scraper feature to assist in removing dried-on materials from at least one floor surface.

One method for removing dirt and other loose debris from a floor surface is by sweeping the dirt using a hand-held broom. Brooms are generally not effective in removing "dried-on" debris which has hardened on a floor surface. For example, bristles of conventional brooms are often of insufficient strength to dislodge hardened food debris, such as oatmeal, ice cream, hard candy, etc. A sweeping system capable of effectively assisting removal and sweeping of such hardened materials would be useful.

OBJECTS AND FEATURES OF THE INVENTION

A primary object and feature of the present invention is to provide a system overcoming the above-mentioned problem(s).

It is a further object and feature of the present invention to provide such a system that incorporates a means for scraping hardened floor debris as part of a sweeping system.

It is a further object and feature of the present invention to provide such a system that incorporates a means for scraping hardened floor debris as part of a hand-held broom.

It is a further object and feature of the present invention to provide such a system that is easily deployable from a stowed position and easily stowed.

It is a further object and feature of the present invention to provide such a system that utilizes spring-tensioned telescoping shafts to provide manually positioned scraping mode or sweeping mode.

It is a further object and feature of the present invention to provide such a system that provides housing for the scraper when not in use that protects both the scraper and the broom (sweep) bristles.

It is a further object and feature of the present invention to provide such a system that provides housing for the scraper when not in use that protests accidental contact with the scraper blade.

It is a further object and feature of the present invention to provide such a system that provides at least one force-resister to assist resisting such scraper from accidentally leaving such housing when not in use.

It is a further object and feature of the present invention to provide such a system that provides at least one force-assister to assist returning such scraper to such housing after scraper use.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a sweeper system, relating to sweeping at least one surface, comprising: at least one bristle holder structured and arranged to hold a plurality of bristles to assist sweeping of the at least one surface; wherein such at least one bristle holder comprises a longitudinal span direction (X) and a transverse span direction (Y); and wherein such plurality of bristles extend at least in a direction (Z) perpendicular from such at least one bristle holder longitudinal span direction (X) and such transverse span direction (Y); and at least one bristle holder handle structured and arranged to assist user-sweeping with such at least one bristle holder; wherein such at least one bristle holder handle extends perpendicularly from such at least one bristle holder in an about opposed direction from such plurality of bristles; and at least one scraper blade structured and arranged to scrape the at least one surface; wherein such at least one scraper blade comprises at least one scraper blade handle structured and arranged to assist scraping with such at least one scraper blade; wherein such at least one scraper blade handle is coaxial with such at least one bristle holder handle; wherein such at least one scraper blade comprises at least two positions along such axis, at least one first (working) position wherein such at least one scraper blade is in at least one working position extending downwardly from such at least one bristle holder and such plurality of bristles; and at least one second (stowed) position wherein such at least one scraper blade is in at least one stowed position extending downwardly from such at least one bristle holder; and wherein such at least one second (stowed) position permits use of the bristle bottoms for sweeping; and at least one scraper-blade-protector structure adapted to protest against accidental contact with such at least one scraper blade at least when such at least one scraper blade is in such at least one second (stowed) position; and at least one coupler to couple such at least one bristle holder to such at least one scraper-blade-protector structure; wherein such co-axial at least one bristle holder handle and such at least one scraper blade handle are structured and arranged to assist movement of such at least one scraper blade between such at least one first (working) position and such at least one second (stowed) position.

Moreover, it provides such a sweeper system, wherein: such at least one scraper blade, when in such at least one first (working) position, is rotatable to at least one third (perpendicular scraping) position about perpendicular to such at least one bristle holder longitudinal span direction (X); and such at least one scraper blade, when in such at least one first (working) position, may be locked into such at least one third (perpendicular scraping) position (Z). Additionally, it provides such a sweeper system further comprising: at least one first force assister structured and arranged to assist such at least one scraper blade to move between such at least one first (working) position and such at least one second (stowed) position; and at least one second force assister structured and arranged to assist such at least one scraper blade to be restrained from moving from such at least one second (stowed) position to such at least one first (working) position. Also, it provides such a sweeper system, wherein: such coaxial arrangement between such at least one scraper blade handle and such at least one bristle holder handle comprises at least one extendable telescopic cylinder, having at least one inner cylinder and at least one outer cylinder in telescopic arrangement, structured and arranged to provide at least one telescopic extension of such at least one inner cylinder relative to such at least one outer cylinder; such at least one inner cylinder comprises such at least one scraper blade handle; and such at least one outer cylinder comprises such at least one bristle holder handle; wherein such at least one telescopic extension of such at least one inner cylinder relative to such at least one outer cylinder provides at least one longitudinal extension of such least one scraper blade relative to such at least one scraper-blade-protector structure; and wherein essentially complete retraction of such at least one inner cylinder relative to such at least one outer cylinder provides at least one longitudinal retraction of such least one scraper blade into such at least one scraper-blade-protector structure.

In addition, it provides such a sweeper system wherein: such at least one first force assister comprises at least one spring tensioner structured and arranged to assist spring-tension positioning of such at least one scraper blade into such at least one scraper-blade-protector structure. And, it provides such a sweeper system wherein such at least one second force assister comprises at least one friction-resistance restrainer structured and arranged to friction-resistance restrain such at least one scraper blade from moving from such at least one second (stowed) position to such at least one first (working) position. Further, it provides such a sweeper system further comprising at least one stowed-scraper lock element structured and arranged to assist locking such at least one scraper blade in such at least one second (stowed) position.

Even further, it provides such a sweeper system wherein: such at least one first force assister comprises at least one spring tensioner structured and arranged to spring tension such at least one inner cylinder within such at least one outer cylinder; and such spring tensioning assists positioning such at least one scraper blade into such at least one scraper-blade-protector structure. Moreover, it provides such a sweeper system wherein such at least one second force assister comprises at least one friction-resistance restrainer structured and arranged to friction-resistance restrain such at least one scraper blade from moving from such at least one second (stowed) position to such at least one first (working) position. Additionally, it provides such a sweeper system further comprising at least one scraper-working lock element structured and arranged to assist locking such at least one scraper blade in such at least one first (working) position.

Also, it provides such a sweeper system wherein such at least one stowed-scraper lock element comprises at least one bayonet lock structured and arranged to assist bayonet locking such at least one scraper blade in such at least one second (stowed) position. In addition, it provides such a sweeper system wherein such at least one scraper-blade-protector structure comprises: at least one sleeve structured and arranged to permit such least one scraper blade to be fully sleeved within the perimeter of such at least one sleeve; wherein, when such least one scraper blade is fully sleeved within the perimeter of such at least one sleeve, accidental contact with such at least one scraper blade is substantially reduced. And, it provides such a sweeper system further comprising at least one perpendicular-scraper lock element structured and arranged to assist locking such at least one scraper blade from moving from such at least one third (perpendicular scraper) position (Z).

Further, it provides such a sweeper system wherein such at least one perpendicular-scraper lock element comprises at least one bayonet lock structured and arranged to removably bayonet lock such at least one scraper blade from moving from such at least one third (perpendicular scraper) position (Z). Even further, it provides such a sweeper system wherein such at least one friction-assistor comprises at least one pair of mirrored rib portions, situate inside such perimeter of such at least one sleeve, structured and arranged to friction contact such at least one scraper blade when such at least one scraper blade is fully sleeved in such at least one sleeve. Moreover, it provides such a sweeper system wherein such at least one friction-assistor comprises at least one pair of mirrored rib portions, situate inside the perimeter of such at least one scraper-blade-protector structure, structured and arranged to friction contact such at least one scraper blade when such at least one scraper blade is fully within such at least one scraper-blade-protector structure.

Additionally, it provides such a system wherein such at least one scraper blade is removably attachable to such at least one scraper blade handle. Also, it provides such a system wherein such at least one scraper blade is removably attachable to such at least one scraper blade handle. In addition, it provides such a system wherein such at least one scraper blade handle is structured and arranged to couple with and operate at least one additional attachment usable with at least a scraping motion. And, it provides such a system wherein such at least one additional attachment comprises at least one squeegee.

In accordance with another preferred embodiment hereof, this invention provides a sweeper system, relating to sweeping at least one surface, comprising: at least one bristle holder structured and arranged to hold a plurality of bristles to assist sweeping of the at least one surface; wherein such at least one bristle holder comprises a longitudinal span direction (X) and a transverse span direction (Y); and wherein such plurality of bristles extend at least in a direction (Z) perpendicular from such at least one bristle holder longitudinal span direction (X) and such transverse span direction (Y); and at least one bristle holder handle structured and arranged to assist user-sweeping with such at least one bristle holder; wherein such at least one bristle holder handle extends perpendicularly from such at least one bristle holder in an about opposed direction from such plurality of bristles; and at least one scraper blade structured and arranged to scrape the at least one surface; wherein such at least one scraper blade comprises at least one scraper blade handle structured and arranged to assist scraping with such at least one scraper blade; wherein such at least one scraper blade handle is coaxial with such at least one bristle holder handle; wherein such at least one scraper blade comprises at least two positions along the axis, at least one first (working) position wherein such at least one scraper blade is in at least one working position extending downwardly from such at least one bristle holder and such plurality of bristles; and at least one second (stowed) position wherein such at least one scraper blade is in at least one stowed position extending downwardly from such at least one bristle holder; and wherein such at least one second (stowed) position permits use of the bristle bottoms for sweeping; and wherein such co-axial at least one bristle holder handle and such at least one scraper blade handle are structured and arranged to assist movement of such at least one scraper blade between such at least one first (working) position and such at least one second (stowed) position; and wherein such at least one scraper blade, when in such at least one first (working) position, is rotatable to at least one third (perpendicular scraper) position (Z) about perpendicular to such at least one bristle holder longitudinal span direction (X). Further, it provides such a sweeper system wherein such at least one scraper blade, when in such at least one first (working) position, may be locked into such at least one third (perpendicular scraper) position.

In accordance with another preferred embodiment hereof, this invention provides a sweeper system, relating to sweeping at least one surface, comprising: at least one bristle holder structured and arranged to hold a plurality of bristles to assist sweeping of the at least one surface; at least one bristle holder handle structured and arranged to assist user-sweeping with such at least one bristle holder; at least one scraper blade structured and arranged to scrape the at least one surface; wherein such at least one scraper blade comprises at least one scraper blade handle structured and arranged to assist scraping with such at least one scraper blade; wherein such at least one scraper blade comprises at least two positions, at least one first position wherein such at least one scraper blade is in at least one working position extending downwardly from such at least one bristle holder and such plurality of bristles; and at least one second position wherein such at least one scraper blade is in at least one stowed position extending downwardly from such at least one bristle holder; and wherein such at least one second (stowed) position permits use of the bristle bottoms for sweeping; and at least one scraper-blade-protector structure adapted to protest against accidental contact with such at least one scraper blade at least when such at least one scraper blade is in such at least one second (stowed) position.

Even further, it provides such a sweeper system wherein such at least one scraper-blade-protector structure comprises: at least one sleeve structured and arranged to permit such least one scraper blade to be fully sleeved within the perimeter of such at least one sleeve; wherein, when such least one scraper blade is fully sleeved within the perimeter of such at least one sleeve, accidental contact with such at least one scraper blade is substantially reduced. Even further, it provides such a sweeper system wherein: such at least one scraper-blade-protector structure comprises at least one friction-resistance restrainer structured and arranged to friction-resistance restrain such at least one scraper blade from moving from such at least one second (stowed) position to such at least one first (working) position; and such at least one friction-resistance restrainer is structured and arranged to friction contact such at least one scraper blade when such at least one scraper blade is fully sleeved in such at least one sleeve.

In accordance with a preferred embodiment hereof, this invention provides a sweeper system, relating to sweeping at least one surface, comprising: at least one grippable handle structured and arranged to provide handle-assisted gripping; wherein such at least one grippable handle comprises at least one extendable telescopic cylinder, having at least one inner cylinder and at least one outer cylinder in telescopic arrangement, structured and arranged to provide at least one telescopic extension of such at least one inner cylinder relative to such at least one outer cylinder, at least one rotation blocker structured and arranged to block rotation between such at least one inner cylinder and such at least one outer cylinder when in telescopic arrangement, at least one sweeper structured and arranged to assist sweeping of the at least one surface, and at least one scraper structured and arranged to scrape the at least one surface; wherein such at least one inner cylinder and such at least one outer cylinder each comprise at least one upper portion and at least one lower portion; wherein such at least one sweeper is coupled to the at least one lower portion of such at least one outer cylinder; wherein such at least one scraper is coupled to the at least one lower portion of such at least one inner cylinder; wherein such at least one telescopic extension of such at least one inner cylinder relative to such at least one outer cylinder provides at least one longitudinal extension of such at least one scraper relative to such at least one sweeper; and wherein such at least one rotation blocker blocks rotation of such at least one scraper relative to such at least one sweeper during such longitudinal extension.

Moreover, it provides such a system wherein such at least one grippable handle further comprises at least one positioner structured and arranged to assist positioning of such at least one scraper in at least one housed position, and at least one scraping position. Additionally, it provides such a system wherein: such at least one positioner comprises at least one spring tensioner structured and arranged to spring tension such at least one inner cylinder within such at least one outer cylinder; and such spring tensioning positions such at least one scraper in such at least one housed position. Also, it provides such a system wherein such at least one spring tensioner is structured and arranged to operate by manually-initiated longitudinal force applied to such at least one inner cylinder to position such at least one scraper in such at least one scraping position.

In addition, it provides such a system wherein such inner cylinder comprises at least one shaft. And, it provides such a system wherein such at least one rotation blocker is structured and arranged to prevent such at least one shaft from rotating in such outer cylinder during scraping.

Further, it provides such a system wherein such at least one rotation blocker comprises a hexagonally-shaped shaft. Even further, it provides such a system wherein such rotation blocker is structured and arranged to prevent such at least one inner cylinder from rotating in such outer cylinder during scraping. Moreover, it provides such a system wherein such rotation blocker comprises nested telescoping cylinders comprising at least one geometry to prevent rotation of such nested telescoping cylinders in relation to each other.

Additionally, it provides such a system wherein such at least one positioner comprises at least one torsion spring. Also, it provides such a system wherein such at least one positioner comprises at least one compression spring. In addition, it provides such a system wherein such inner cylinder comprises at least one shaft. And, it provides such a system wherein such at least one spring tensioner comprises: at least one upper end; at least one lower end; wherein such at least one upper end is attached to such at least one outer cylinder and such at least one lower end is attached to such at least one inner cylinder. Further, it provides such a system wherein such at least one spring tensioner comprises: at least one upper end; at least one lower end; wherein such at least one upper end is attached to such at least one outer cylinder and such at least one lower end is attached to such at least one shaft.

In accordance with another preferred embodiment hereof, this invention provides a sweeper system, relating to sweeping at least one surface, comprising: at least one sweeper structured and arranged to sweep the at least one surface; and at least one scraper structured and arranged to scrape the at least one surface; wherein such at least one sweeper comprises at least one housing structured and arranged to house such at least one scraper; wherein such at least one sweeper comprises at least one handle structured and arranged to assist hand-operation of such at least one sweeper; wherein such at least one handle comprises such at least one scraper, wherein such at least one handle is structured and arranged to assist hand-operation of such at least one scraper; wherein such at least one handle comprises at least one positioner structured and arranged to assist positioning of such at least one scraper in at least one housed position, and at least one scraping position; and wherein when such at least one scraper is in such at least one housed position, such at least one scraper is prevented from scraping; wherein such at least one handle comprises at least one extendable telescopic cylinder, having at least one inner cylinder and at least one outer cylinder in telescopic arrangement, structured and arranged to provide at least one telescopic extension of such at least one inner cylinder relative to such at least one outer cylinder; wherein such at least one inner cylinder and such at least one outer cylinder each comprise at least one upper portion and at least one lower portion; wherein such at least one sweeper is coupled to the at least one lower portion of such at least one outer cylinder; wherein such at least one scraper is coupled to the at least one lower portion of such at least one inner cylinder; wherein such at least one telescopic extension of such at least one inner cylinder relative to such at least one outer cylinder provides at least one longitudinal extension of such at least one scraper relative to such at least one sweeper; wherein such at least one handle comprises at least one rotation blocker structured and arranged to block rotation between such at least one inner cylinder and such at least one outer cylinder when in telescopic arrangement.

Even further, it provides such a system wherein such at least one positioner comprises: at least one spring tensioner structured and arranged to spring tension such at least one inner cylinder within such at least one outer cylinder; wherein such spring tensioning positions such at least one scraper in such at least one housed position; and wherein such at least one spring tensioner is structured and arranged to operate by manually-initiated longitudinal force applied to such at least one inner cylinder to position such at least one scraper in such at least one scraping position. Even further, it provides such a system wherein such at least one positioner comprises at least one torsion spring. Even further, it provides such a system wherein such at least one positioner comprises at least one compression spring.

In accordance with another preferred embodiment hereof, this invention provides a system, relating to sweeping at least one surface, comprising: grippable handle means for providing handle assisted gripping; wherein such grippable handle means comprises extendable telescopic cylinder means, having at least one inner cylinder and at least one outer cylinder in telescopic arrangement, for providing at least one telescopic extension of at least one inner cylinder relative to at least one outer cylinder, rotation blocker means for blocking rotation between such at least one inner cylinder and such at least one outer cylinder when in telescopic arrangement, sweeper means for assisting sweeping of the at least one surface, and scraper means for scraping the at least one surface; wherein such at least one inner cylinder and such at least one outer cylinder each comprise at least one upper portion and at least one lower portion; wherein such sweeper means is coupled to the at least one lower portion of such at least one outer cylinder; wherein such scraper means is coupled to the at least one lower portion of such at least one inner cylinder; wherein such at least one telescopic extension of such at least one inner cylinder relative to such at least one outer cylinder provides at least one longitudinal extension of such at least one scraper means relative to such sweeper means; and wherein such rotation block means blocks rotation of such scraper means relative to such sweeper means during such longitudinal extension.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

A broom is often used to sweep and clean floors and is one standard tool for that purpose. Brooms are usually effective for moving loose dirt, dust, or debris; such removal is accomplished through the act of sweeping. It is difficult to sweep debris that is not loose and/or adhered to a surface using a broom. Separate tools or cleaning devices may be required to remove stuck-on-debris. Use of such separate tools or cleaning devices can disrupt the act of sweeping and take additional time to complete over and above such sweeping.

Figure 1:
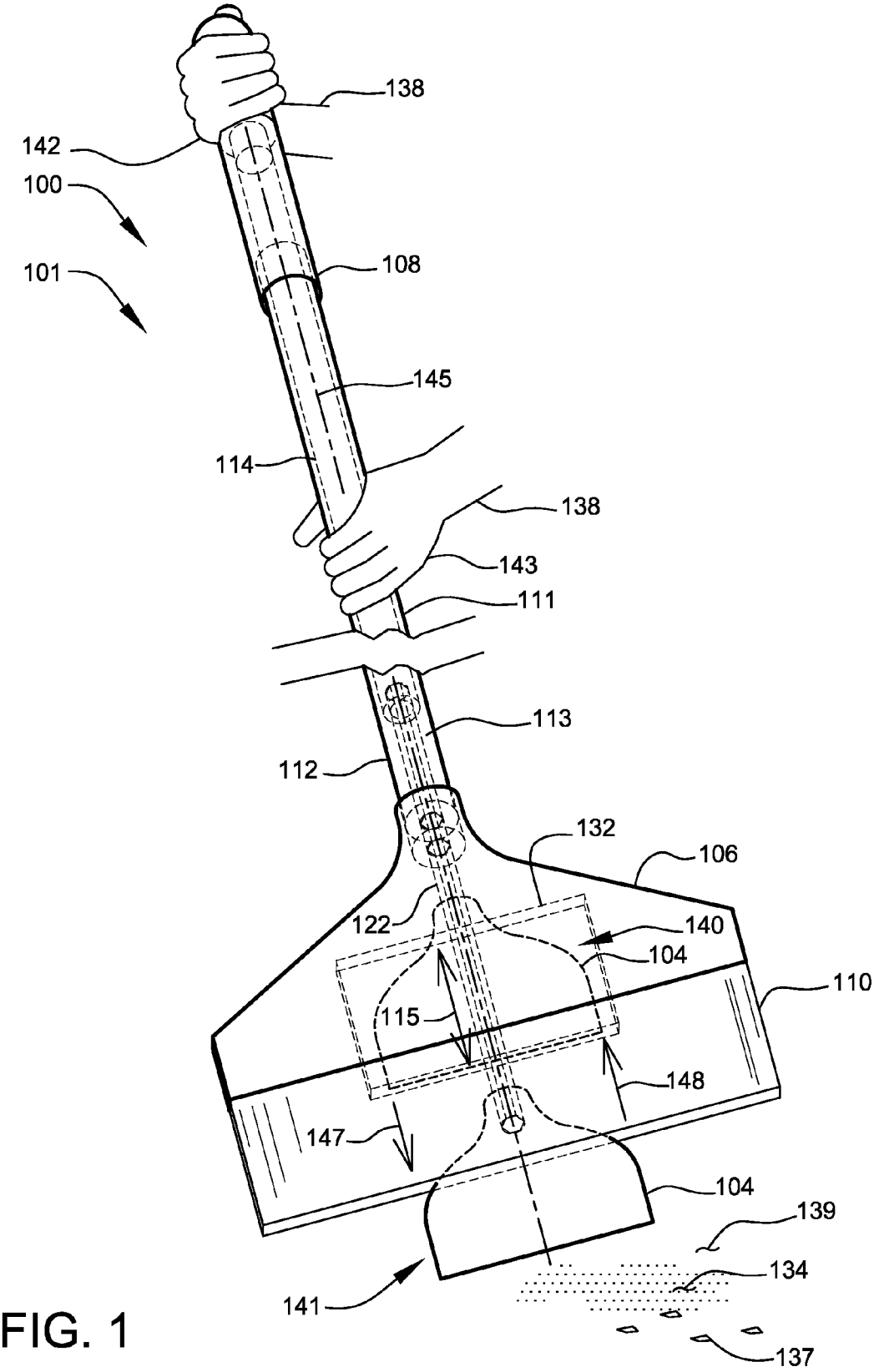
FIG. 1 shows a perspective view illustrating an enhanced broom sweeper of the enhanced sweeping systems, according to a preferred embodiment of the present invention.

FIG. 1 shows a perspective view illustrating an enhanced broom sweeper 101 according to a preferred embodiment of enhanced sweeper system 100 of the present invention. FIG. 1 shows at least one default retracted position 140 and at least one extended position 141. Enhanced broom sweeper 101 preferably incorporates a means for scraping hardened floor debris, preferably in the form of a deployable blade-type scraper 104, as shown. Blade-type scraper 104 is preferably structured and arranged to be easily deployable, as needed, and stowed within the interior of broom head 106 when not in use.

Enhanced sweeper system 100 preferably combines broom sweeping capability with the preferred ability to scrape, when necessary. Enhanced broom sweeper 101 preferably comprises broom bristles 110, preferably attached to broom head 106. Broom bristles 110 (at least embodying herein sweeper means for assisting sweeping of the at least one surface) preferably permit enhanced broom sweeper 101 to sweep loose debris 134. Enhanced broom sweeper 101 preferably includes at least one built-in blade-type scraper 104. Blade-type scraper 104 (at least embodying herein scraper means for scraping the at least one surface) is preferably deployable to at least one extended position 141 to remove stuck-on debris 137. Temporary deployment of blade-type scraper 104 is preferably done whenever stuck-on debris 137 needs to be removed.

Blade-type scraper 104 is preferably attached to at least one rod 122. Alternately preferably, blade-type scraper 104 is removably attachable to at least one rod 122 (at least embodying herein wherein said at least one scraper is removably attachable to said at least one handle). Rod 122 preferably is connected to at least one inner-tubular shaft 114. Rod 122 and inner-tubular shaft 114 are preferably located at the inside 113 of at least one outer handle sleeve 112. Inner-tubular shaft 114 is preferably attached to at least one upper graspable handle 108. In use, a user 138 preferably holds upper graspable handle 108 with upper hand 142 while preferably holding at least one lower graspable handle 111 with lower hand 143, as shown (this arrangement at least embodies herein grippable handle means for providing handle assisted gripping).

Rod 122 and inner-tubular shaft 114 preferably utilize telescopic movement 115 within outer handle sleeve 112. Telescopic movement 115 (at least embodying herein extendable telescopic cylinder means, having at least one inner cylinder and at least one outer cylinder in telescopic arrangement, for providing at least one telescopic extension of at least one inner cylinder relative to at least one outer cylinder) of rod 122 and inner-tubular shaft 114 preferably occur during user 138 deployment 147 and retraction 148 of blade-type scraper 104. Blade-type scraper 104 preferably resides inside at least one sleeve 132 when in default-retracted position 140. Preferably, sleeve 132 comprises a housing that both protects the blade-type scraper 104 and keeps the broom bristles 110 from being damaged by the scraper blade, as shown.

Figure 2:
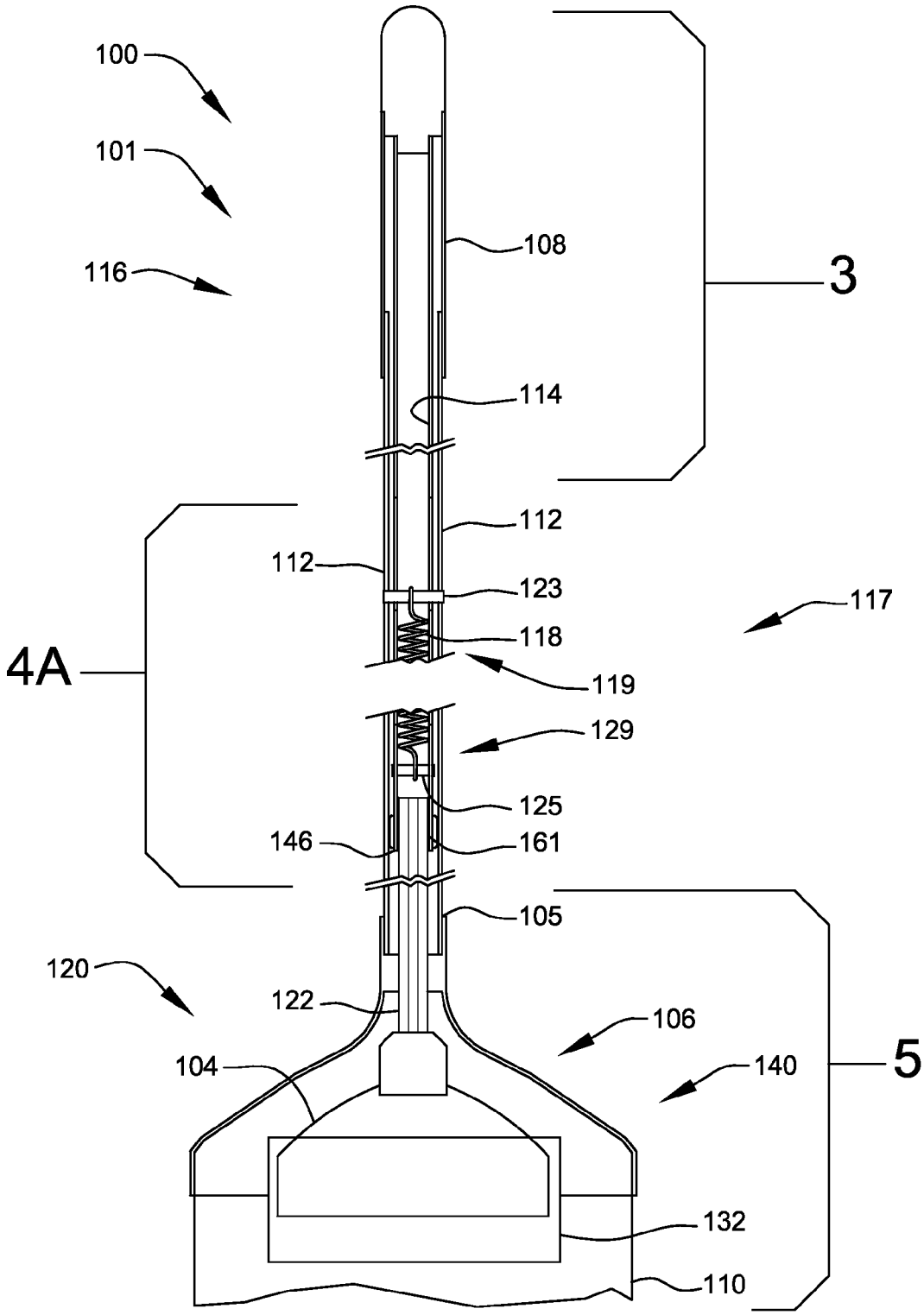
FIG. 2 shows a longitudinal sectional view, through section 2-2 of FIG. 1.

FIG. 2 shows a longitudinal sectional view, through section 2-2 of FIG. 1. FIG. 2 shows a sectional view, through a longitudinal section intersecting approximately the midline of the apparatus 145, illustrating preferred internal arrangements of enhanced broom sweeper 101 in the default retracted position 140, according to the preferred embodiment of enhanced sweeper system 100 of FIG. 1. Enhanced broom sweeper 101 preferably comprises upper portion 116, middle portion 117 and lower portion 120. Upper portion 116 consists of upper graspable handle 108 that preferably controls movement of at least one inner shaft assembly 129. Middle portion 117 preferably comprises at least one tension spring system 119 that preferably retracts inner shaft assembly 129 and blade-type scraper 104. And, enhanced broom sweeper 101 preferably comprises lower portion 120, preferably consisting of at least one broom head 106, preferably comprising broom bristles 110, and preferably comprising at least one blade-type scraper 104, preferably one blade-type scraper 104.

Figure 4A:
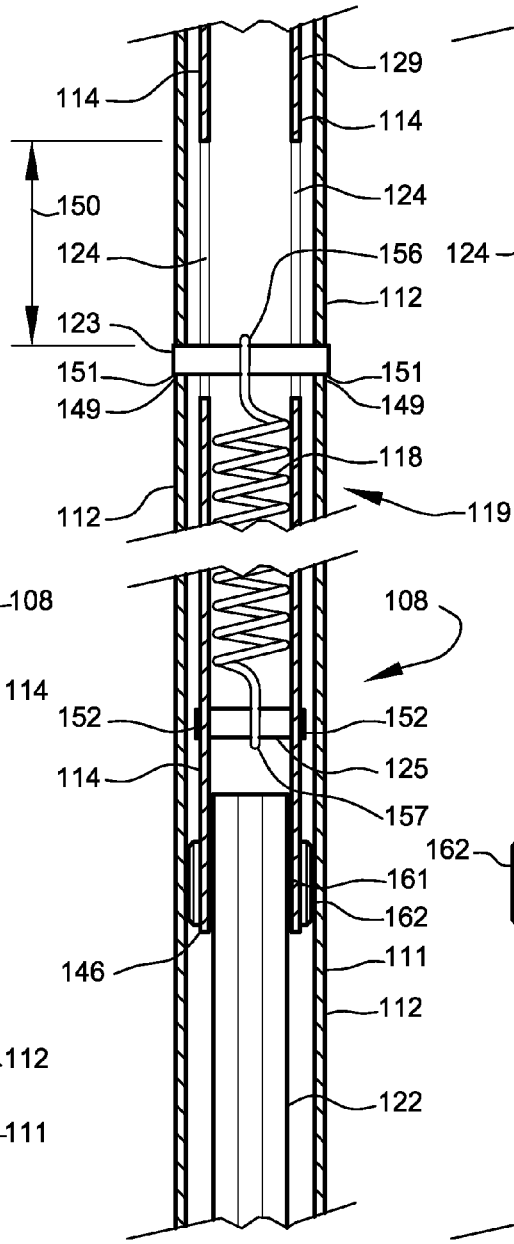
FIG. 4A shows a section view of Detail 4 of FIG. 2.

Rod 122 is preferably attached by tight friction fit 161 to bottom 146 of inner-tubular shaft 114, as best shown in FIG. 4A. Upper graspable handle 108, inner-tubular shaft 114, rod 122, and scraper 104 all preferably make up inner shaft assembly 129 as shown (see FIG. 2).

Inner shaft assembly 129 preferably moves telescopically within outer handle sleeve 112. Telescopic movement 115 of inner shaft assembly 129 preferably occurs during either deployment 147 or retraction 148 of scraper 104, as shown (see FIGS. 4A and 4B). Spacer-guide ring 162 is preferably attached around inner-tubular shaft 114 at bottom 146 to guide movement of inner-tubular shaft 114 within outer handle sleeve 112. Spacer-guide ring 162 preferably comprises plastic-outer face 164, preferably formed to outer perimeter 165 of spacer-guide ring 162. Spacer-guide ring 162 preferably is attached around inner-tubular shaft 114 by tight friction fit 163. Upon reading this specification, those with ordinary skill in the art will now appreciate that, under appropriate circumstances, considering such issues as design preference, user preferences, marketing preferences, cost, structural requirements, available materials, technological advances, etc., other shaft arrangements such as, for example, opposed inner and outer shaft movement, etc., may suffice.

Figure 3:
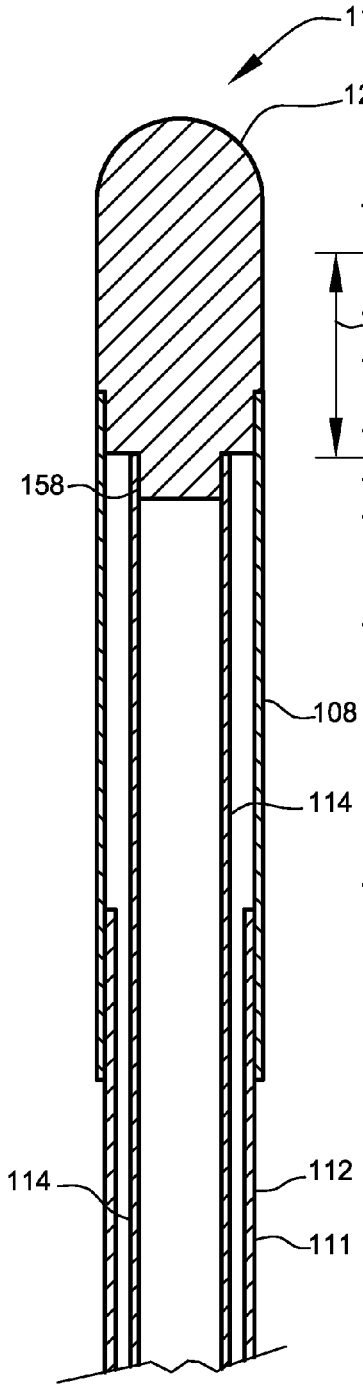
FIG. 3 shows a section view of Detail 3 of FIG. 2.
Figure 6:
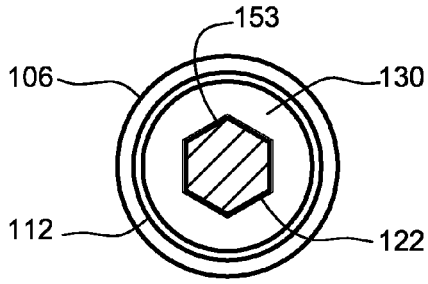
FIG. 6 shows a section view through the section 6-6 of FIG. 5.

FIG. 3 shows a section view of Detail 3 of FIG. 2. FIG. 3 shows a partial sectional view through the upper portion 116 of upper graspable handle 108 of enhanced broom sweeper 101, according to the preferred embodiment of enhanced sweeper system 100 of FIG. 2. Upper portion 116 of enhanced broom sweeper 101 preferably comprises upper graspable handle 108. Graspable handle 108 is preferably configured to contain a mechanical operator assembly adapted to deploy and retract blade-type scraper 104, as shown and further described. Upper graspable handle 108 comprises at least one upper grip 126, as shown. At least one upper grip 126 is preferably connected to inner-tubular shaft 114 by at least one attachment 158, as shown. Upper graspable handle 108 is preferably pushed by upper hand 142, as shown (see FIG. 1), to preferably provide telescopic movement 115 of inner-tubular shaft 114. Telescopic movement 115 preferably occurs within handle sleeve 112. Upper graspable handle 108 preferably moves over outer handle sleeve 112 during pushing. The upper portion of inner tubular shaft 114 preferably comprises an elongation hollow tube having an outer diameter slightly smaller than the interior diameter of outer handle sleeve 112, as shown. Preferably, a substantially rigid non-circular rod 122 (preferably of hexagonal cross-section as shown in FIG. 6) is firmly fixed within the lower bore of inner tubular shaft 114 and preferably extends in a downward direction to engage blade-type scraper 104, as shown.

FIG. 4A shows a section view of Detail 4 of FIG. 2. FIG. 4A shows a partial sectional view through the middle portion 117 of the lower graspable handle 111 of enhanced broom sweeper 101, according to the preferred embodiment of enhanced sweeper system 100 of FIG. 2. Middle portion 117 of enhanced broom sweeper 101 preferably houses tension spring system 119. Tension spring system 119 preferably comprises at least one mounting bar 123, at least one tension spring 118, at least one pin 125, at least one inner-tubular shaft 114 and outer handle sleeve 112, as shown. Mounting bar 123 is preferably attached to each side 149 of outer handle sleeve 112 by at least one attachment 151, preferably as shown (and further described below).

Inner tubular shaft 114 is preferably adapted to contain tension spring 118, as shown. The lower end of tension spring 118 is preferably fixed to inner tubular shaft 114, as shown. The upper-opposing end of tension spring 118 is preferably fixed to outer handle sleeve 112, as shown, preferably using a mounting bar 123 extending across the inner bore of outer handle sleeve 112 (in orientation generally perpendicular to the longitudinal axis of the handle). To allow inner tubular shaft 114 to translate telescopically within outer handle sleeve 112 without interference from the mounting bar, a pair of slots 124 are preferably formed within opposing sides of inner tubular shaft 114, at the location of mounting bar 123, as shown.

The upper end of inner tubular shaft 114 preferably engages a user-graspable upper grip 126 preferably adapted to permit the user to manually translate inner tubular shaft 114 up and down within outer handle sleeve 112. The above-described telescopic movement preferably results in the preferred deployment (and retraction) of blade-type scraper 104 from broom head 106 (this arrangement at least embodies herein wherein such at least one telescopic extension of said at least one inner cylinder relative to said at least one outer cylinder provides at least one longitudinal extension of said at least one scraper means relative to said sweeper means). Upon reading this specification, those with ordinary skill in the art will now appreciate that, under appropriate circumstances, considering such issues as cost, user preference, etc., other arrangements such as, for example, providing a positional catch or bayonet-type engagement to temporarily lock the blade in the deployed position, etc., may suffice.

Figure 4B:
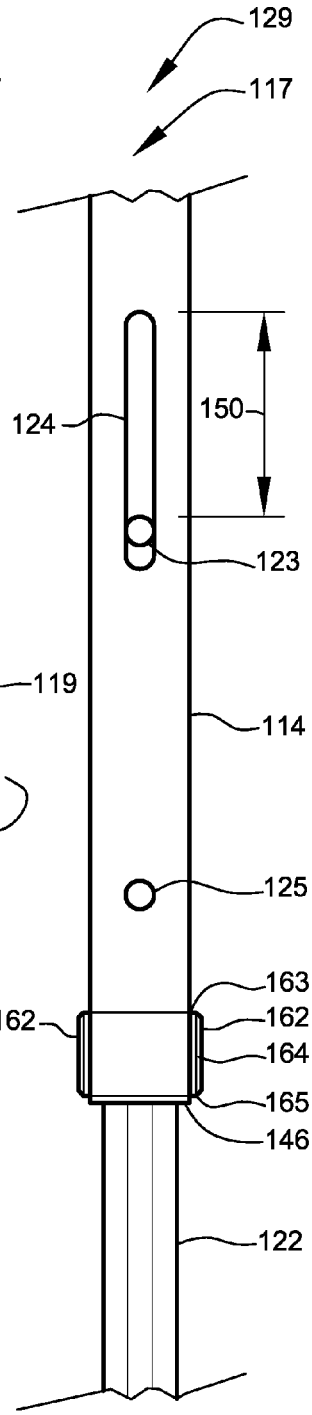
FIG. 4B shows a side outer view of Detail 4 of FIG. 2.

FIG. 4B shows a side outer view of Detail 4 of FIG. 2. FIG. 4B shows a partial front view of the middle portion 117 of the inner-tubular shaft 114 of enhanced broom sweeper 101, according to the preferred embodiment of enhanced sweeper system 100 of FIG. 2. Mounting bar 123 preferably passes through slots 124 of inner-tubular shaft 114. Slots are preferably sized to allow inner shaft assembly 129 full range of motion 150 for retracting and deploying scraper 104. Full range of motion 150 for inner shaft assembly 129 as shown, (see FIG. 4B) preferably ranges from default retracted position 140 to extended position 141 of blade-type scraper 104, as best shown in FIG. 1. Slots 124 preferably permit inner-tubular shaft 114 to move up and down without interference of mounting bar 123.

Pin 125 is preferably mounted to inner-tubular shaft 114 by at least one attachment 152. Pin 125 is preferably located above connection of rod 122 to inner-tubular shaft 114. Function of tension spring system 119 is to preferably retract both inner shaft assembly 129 and blade-type scraper 104 after use.

With reference to FIG. 4A, top 156 of tension spring 118 preferably connects to mounting bar 123. The bottom 157 of tension spring 118 preferably attaches to pin 125. Tension spring 118 preferably retracts inner-tubular shaft 114 upward by preferably (tension) pulling pin 125 relative to outer handle sleeve 112, as shown.

When upper graspable handle 108 is released, tension spring system 119 preferably retracts inner shaft assembly 129 (as best shown in FIG. 2). With reference to FIG. 1, retraction 148 is preferably accomplished through tension spring 118 preferably pulling inner-tubular shaft 114 up relative to outer handle sleeve 112. Retraction 148 preferably pulls blade-type scraper 104 up into sleeve 132. Retracted default position 140 is the preferred natural state of the blade-type scraper 104.

Figure 5:
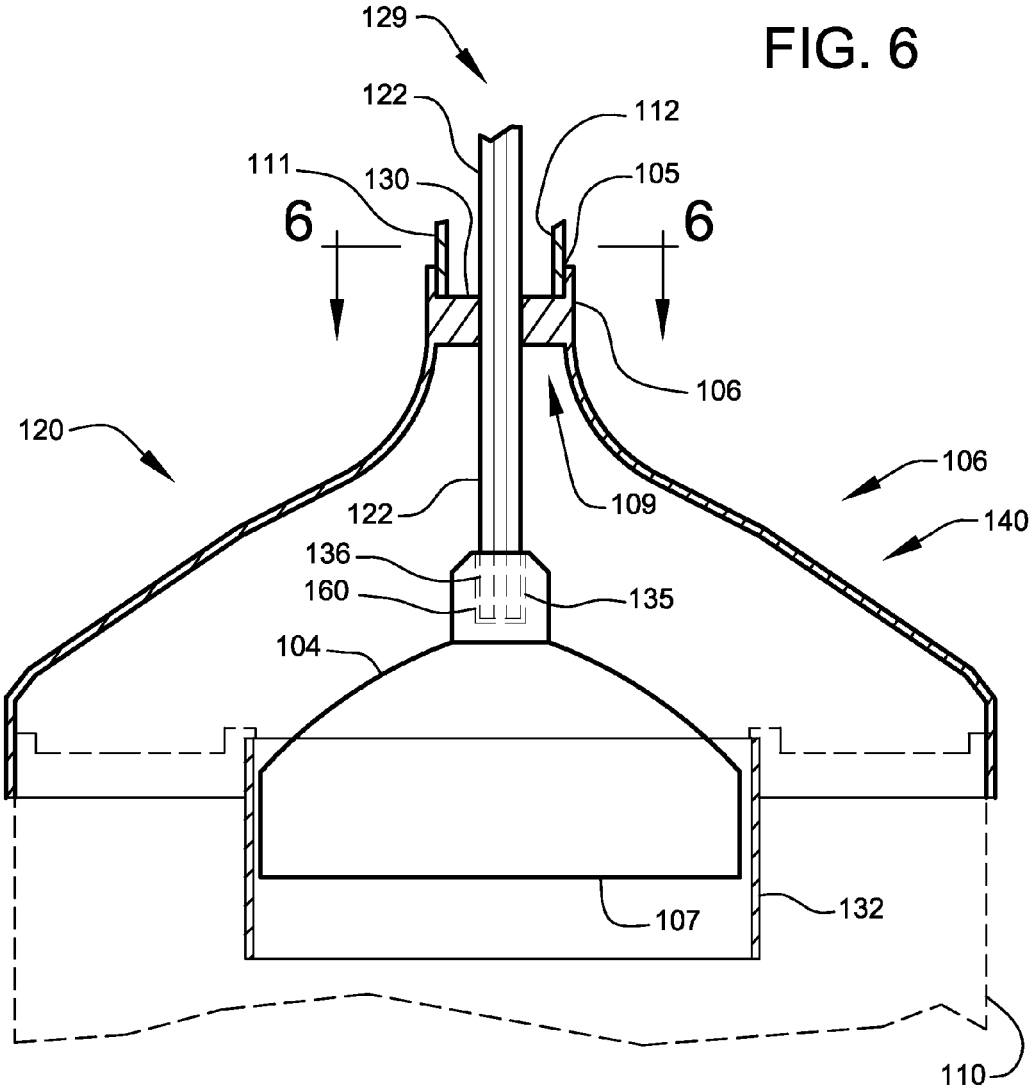
FIG. 5 shows a section view of Detail 5 of FIG. 2.

FIG. 5 shows a section view of Detail 5 of FIG. 2. FIG. 5 shows a partial sectional view through the lower portion 120 of the lower graspable handle 111 and broom head 106 of the enhanced broom sweeper 101, according to the preferred embodiment of enhanced sweeper system 100 of the present invention. Outer handle sleeve 112 of enhanced broom sweeper 101 is preferably connected to broom head 106 by at least one broom head connection 105, preferably at the lower portion of the broom sweeper 101, preferably by tight friction fit (at least embodying herein wherein said sweeper means is coupled to the at least one lower portion of said at least one outer cylinder). Rod 122 extends down past broom head connection 105 and is preferably attached to blade-type scraper 104, preferably at the lower portion of rod 122, as shown (this arrangement at least embodying herein wherein said scraper means is coupled to the at least one lower portion of said at least one inner cylinder). Blade-type scraper 104 comprises a rod-attachment sleeve 135 that attaches to bottom 136 of rod 122, preferably by tight friction fit 160. Blade-type scraper 104 is preferably attached to bottom of inner shaft assembly 129. Blade-type scraper 104 preferably comprises at least one scraper edge 107 at bottom. Bottom edge 107 is preferably utilized to scrape stuck-on debris 137 off at least one surface 139. Stuck-on debris 137 may preferably be swept away once scraped off surface 139. After use, blade-type scraper 104 preferably self retracts. Blade-type scraper 104 preferably stays in its default retracted position 140 when not needed.

Enhanced broom sweeper 101 also preferably comprises sleeve 132 for blade-type scraper 104 to preferably retract into. Sleeve 132 is preferably attached to broom head 106. Sleeve 132 preferably shields broom bristles 110 from blade-type scraper 104. This shielding preferably prevents misshaping or damaging of broom bristles 110.

FIG. 6 shows a section view through the section 6-6 of FIG. FIG. 6 shows a sectional view 6-6 of FIG. 5, illustrating shaft guide assembly 130, according to the preferred embodiment of enhanced sweeper system 100 of the present invention.

Inner portion 109 of broom head 106 preferably comprises at least one shaft guide assembly 130. Shaft guide assembly 130 preferably provides at least one clearance fit 153 around rod 122 inside broom head 106. Function of shaft guide assembly 130 is to preferably keep both rod 122 and blade-type scraper 104 rigid during scraping.

Shaft guide assembly 130 preferably functions to prevent the rotation of circular rod 122 relative to broom head 106. Shaft guide assembly 130 preferably comprises a non-circular bore, as shown, through which non-circular rod 122 passes. The preferred complementary non-circular shapes of the rod and guide assembly prevent the rotation of blade-type scraper 104 during use of the device. The above-described arrangement embodies herein rotation blocker means for blocking rotation between said at least one inner cylinder and said at least one outer cylinder when in telescopic arrangement.

Preferred embodiments of the broom head comprise a hollow rectangular sleeve 132 in which the blade resides. Sleeve 132 preferably functions to maintain an open pocket between broom bristles 110 to allow unencumbered movement of blade-type scraper 104.

Figure 7:
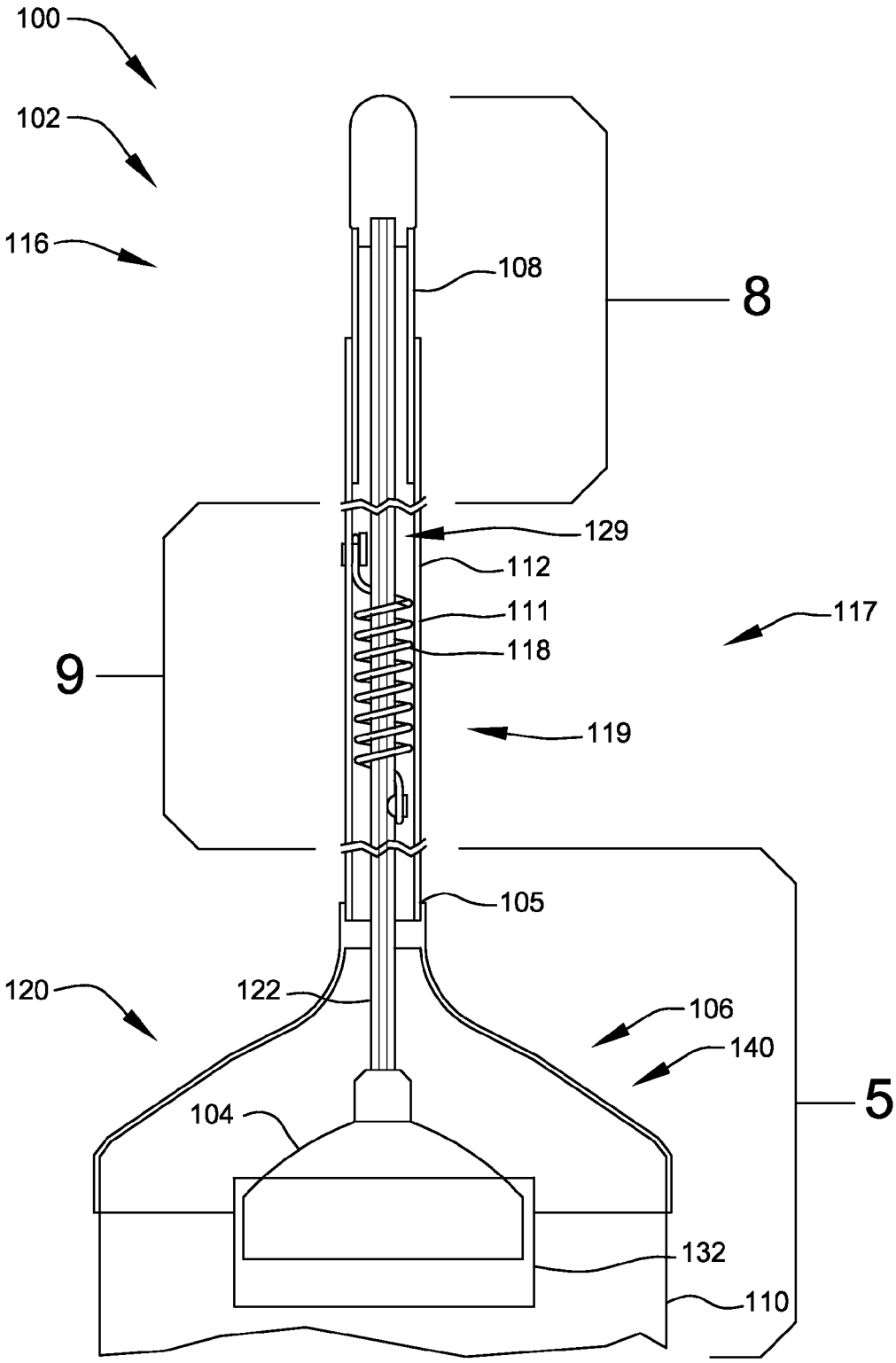
FIG. 7 shows an alternate longitudinal section view to FIG. 2, according to an alternate preferred embodiment of the present invention.

FIG. 7 shows an alternate longitudinal section view to FIG. 2, according to an alternate preferred embodiment of the present invention. FIG. 7 shows a sectional view, through a longitudinal section intersecting approximately the midline of an alternate enhanced broom sweeper 102, illustrating preferred internal arrangements of the apparatus, according to another preferred embodiment of enhanced sweeper system 100 of the present invention. Alternate enhanced broom sweeper 102 preferably comprises an upper portion 116, middle portion 117 and lower portion 120. Upper portion 116 preferably consists of upper graspable handle 108 that preferably controls movement of rod 122. Middle portion 117 preferably comprises tension spring 118 that preferably retracts blade-type scraper 104. And finally, enhanced broom sweeper 102 preferably comprises a lower portion 120; preferably consisting of broom head 106, broom bristles 110, and blade-type scraper 104. Lower portion 120 preferably remains the same as enhanced broom sweeper 102 of FIG. 1.

Rod 122 preferably runs down inside of the entire outer handle sleeve 112 and is preferably attached to blade-type scraper 104 at bottom. Upper graspable handle 108, rod 122, and scraper 104, preferably make up inner shaft assembly 129 as shown (see FIG. 7) Inner shaft assembly 129 preferably moves telescopically within outer handle sleeve 112 during manual hand pushing by a user.

Figure 8:
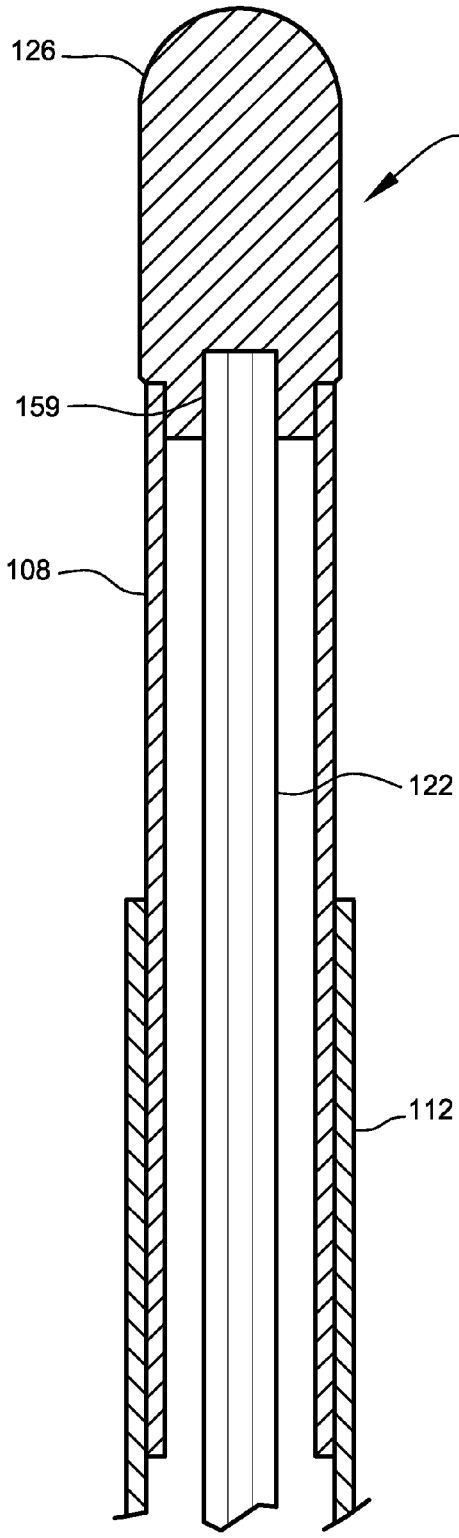
FIG. 8 shows a section view of Detail 8 of FIG. 7.

FIG. 8 shows a section view of Detail 8 of FIG. 7. FIG. 8 shows a partial sectional view through the upper portion 116 of upper graspable handle 108 of the alternate enhanced broom sweeper 102, according to the preferred embodiment of enhanced sweeper system 100 of the present invention. Upper portion 116 of enhanced broom sweeper 102 preferably comprises upper graspable handle 108 (as did enhanced broom sweeper 101). Upper grip 126 is preferably connected to inner rod 122 by at least one attachment 159. Upper graspable handle 108 is also preferably pushed by upper hand 142, as previously shown (see FIG. 1), to preferably provide telescopic movement 115 of inner-tubular shaft 114. Telescopic movement 115 also preferably occurs within handle sleeve 112. Upper graspable handle 108 also preferably moves inside outer handle sleeve 112 during pushing.

Figure 9:
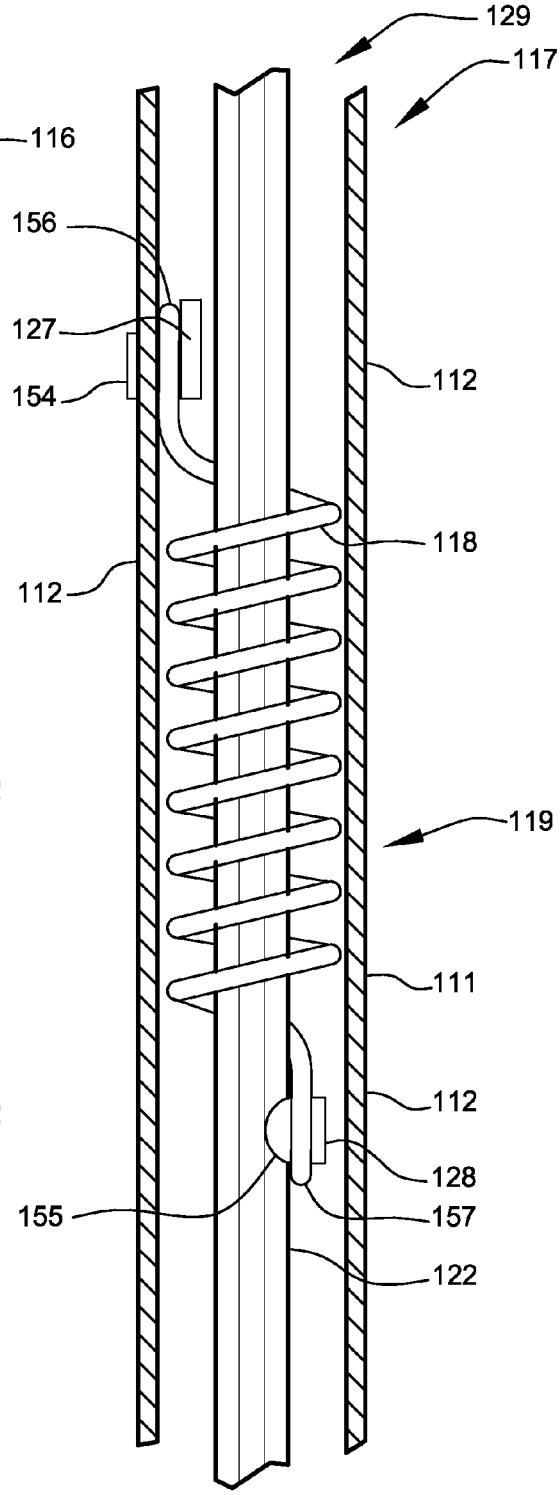
FIG. 9 shows a section view of Detail 8 of FIG. 7.

FIG. 9 shows a section view of Detail 8 of FIG. 7. FIG. 9 shows a partial sectional view through the middle portion 117 of the gripping handle of the alternate enhanced broom sweeper 102, according to the preferred embodiment of FIG. 7. Middle portion 117 of enhanced broom sweeper 102 preferably comprises tension spring system 119. Tension spring system 119 preferably comprises tension spring 118, rod 122, and outer handle sleeve 112. Function of tension spring system 119 is to preferably retract inner shaft assembly 129 and blade-type scraper 104 after use.

At least one upper spring mount 127 is preferably attached to inside of outer handle sleeve 112 by at least one attachment 154. Lower spring mount 128 is preferably attached to rod 122 by at least one attachment 155. Function of tension spring system 119 is to preferably retract both inner shaft assembly 129 and blade-type scraper 104 after use.

Top 156 of tension spring 118 preferably connects to upper spring mount 127. Bottom 157 of tension spring 118 preferably connects to lower spring mount 128. Tension spring 118 preferably retracts rod 122 upward by preferably pulling rod 122 relative to outer handle sleeve 112.

When upper graspable handle 108 is released, tension spring system 119 preferably retracts inner shaft assembly 129. Retraction is preferably accomplished through tension spring 118 preferably pulling rod 122 up relative to outer handle sleeve 112. Retraction pulls blade-type scraper 104 up into sleeve 132. Retracted default position 140 is the preferred, natural state of blade-type scraper 104.

Figure 10:
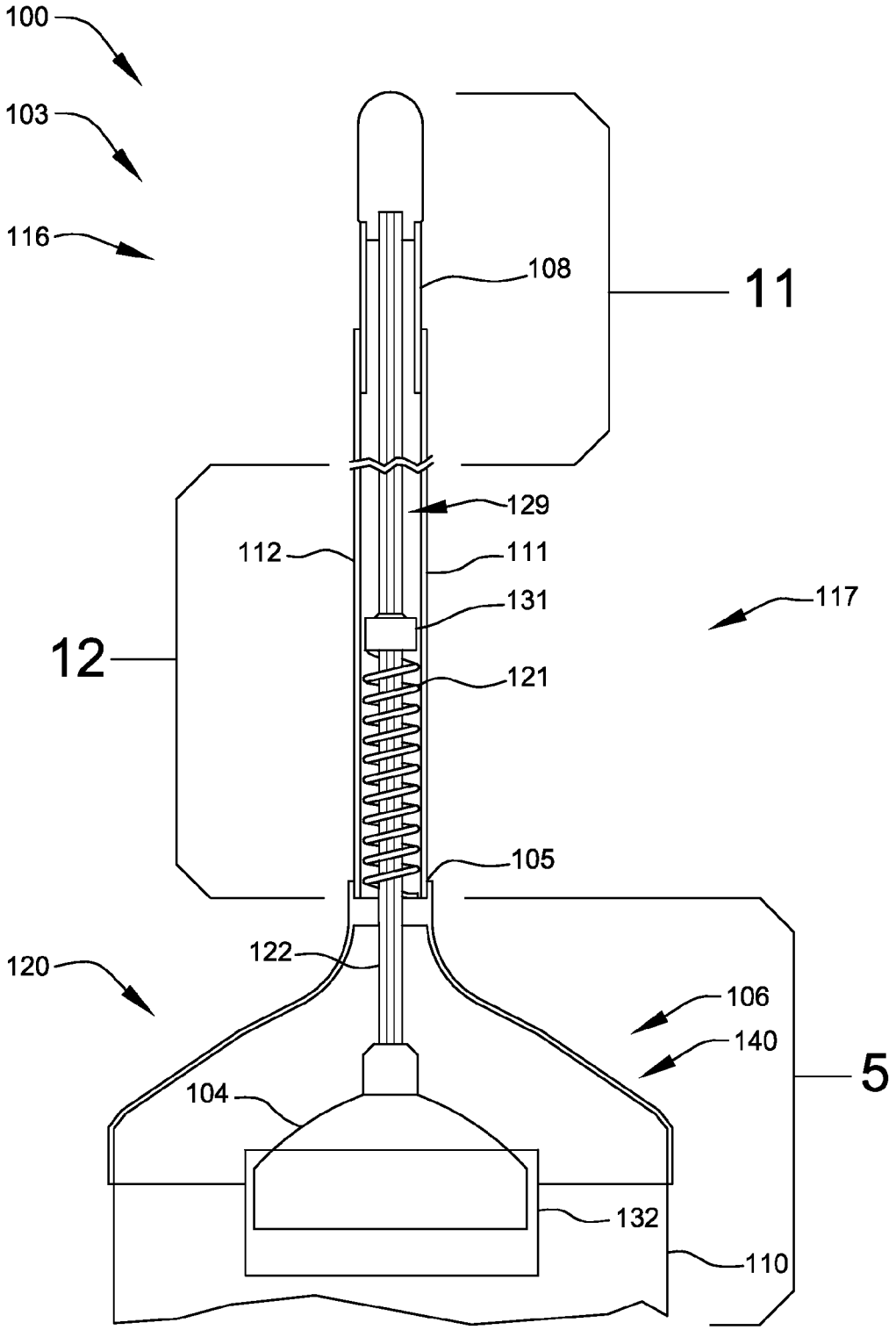
FIG. 10 shows another alternate longitudinal section view to FIG. 2, according to another alternate preferred embodiment of the present invention.

FIG. 10 shows another alternate longitudinal section view to FIG. 2, according to another alternate preferred embodiment of the present invention. FIG. 10 shows a sectional view, through a longitudinal section intersecting approximately the midline of an alternate enhanced broom sweeper 103, illustrating preferred internal arrangements. Alternate enhanced broom sweeper 103 preferably comprises an upper portion 116, middle portion 117 and lower portion 120. Upper portion 116 preferably consists of upper graspable handle 108 that controls movement of rod 122. Middle portion 117 preferably comprises at least one compression spring 121 that preferably retracts blade-type scraper 104, preferably through compression instead of tension. And finally, alternate enhanced broom sweeper 103 preferably comprises a lower portion 120 preferably consisting of broom head 106, broom bristles 110, and blade-type scraper 104.

Rod 122 preferably runs down the inside of entire outer handle sleeve 112 and preferably attaches to blade-type scraper 104 at bottom as shown (see FIG. 10). Upper graspable handle 108, rod 122, spring pusher 131, and scraper 104 preferably make up inner shaft assembly 129. Inner shaft assembly 129 preferably moves telescopically within outer handle sleeve 112 during pushing of upper grip 126 (preferably connected to inner rod 122 by attachment 159).

Figure 11:
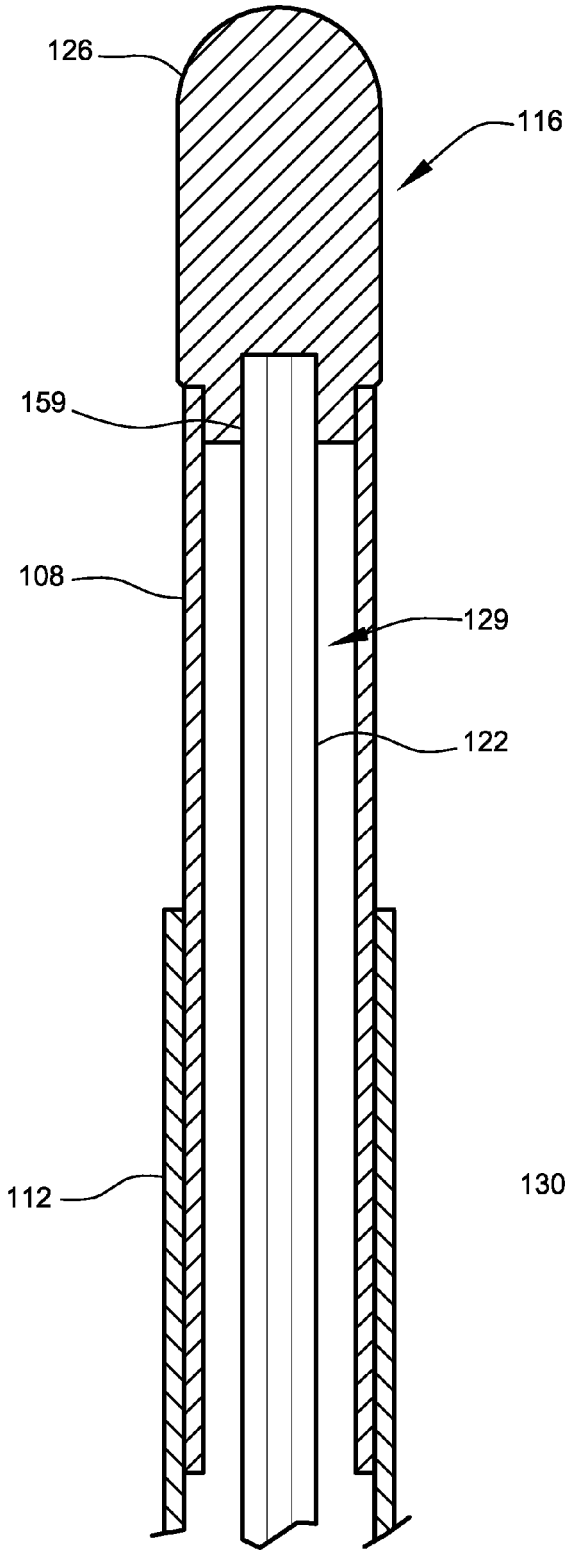
FIG. 11 shows a section view of Detail 11 of FIG. 10.

FIG. 11 shows a section view of Detail 11 of FIG. 10. FIG. 11 shows a sectional view through the upper portion 116 of upper graspable handle 108 of the alternate enhanced broom sweeper 103, according to the preferred embodiment of enhanced sweeper system 100 of the present invention. Upper portion 116 of enhanced broom sweeper 103 preferably comprises upper graspable handle 108 (as did enhanced broom sweeper 101). Upper grip 126 is preferably connected to inner rod 122 by attachment 159. Upper graspable handle 108 is also pushed by upper hand 142, as previously shown (see FIG. 1), to preferably provide telescopic movement 115 of inner-tubular shaft 114. Telescopic movement 115 also preferably occurs within handle sleeve 112. Upper graspable handle 108 also preferably moves inside outer handle sleeve 112 during pushing which then preferably deploys scraper 104 (this arrangement at least embodies herein wherein said at least one grippable handle further comprises at least one positioner structured and arranged to assist positioning of said at least one scraper in at least one house to position, and at least one scraping position).

Figure 12:
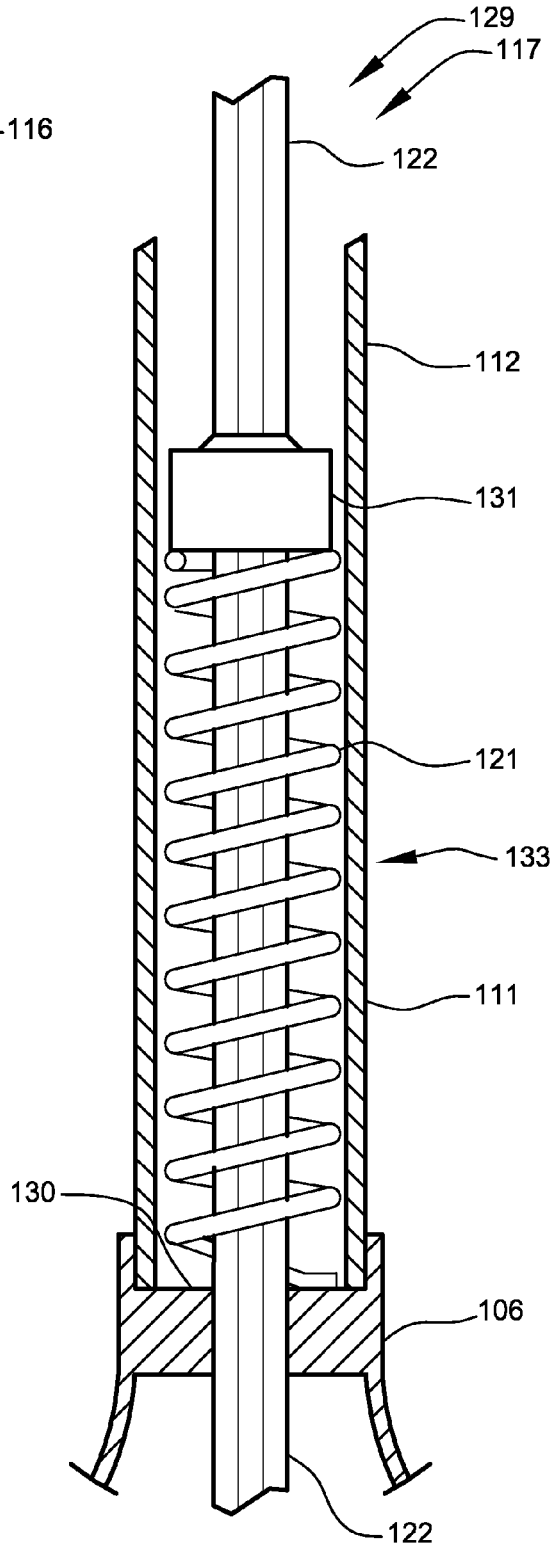
FIG. 12 shows a section view Detail 12 of FIG. 10.

FIG. 12 shows a section view Detail 12 of FIG. 10. FIG. 12 shows a sectional view through the middle portion 117 of the gripping handle of the alternate enhanced broom sweeper 103, according to the preferred embodiment of enhanced sweeper system 100 of the present invention. Middle portion 117 of enhanced broom sweeper 103 preferably comprises at least one compression spring system 133. Compression spring system 133 preferably comprises at least one compression spring 121, rod 122, at least one spring pusher 131, broom head 106 and outer handle sleeve 112. The function of compression spring system 133 is to preferably retract inner shaft assembly 129 and blade-type scraper 104 after use.

Spring pusher 131 is preferably attached to rod 122. Compression spring 121 is preferably located between spring pusher 131 and top portion of shaft guide assembly 130. Top of compression spring 121 is preferably attached to spring pusher 131. Bottom of compression spring 121 is preferably attached to top portion of shaft guide assembly 130.

When upper graspable handle 108 is released, compression spring system 133 preferably retracts inner shaft assembly 129. Retraction is preferably accomplished by compression spring 121, which preferably compresses spring pusher 131 up and away from broom head 106. This preferably retracts rod 122 and blade-type scraper 104 up into sleeve 132. As stated earlier, retracted default position 140 is the preferred natural state of the blade-type scraper 104.

Figure 13A:
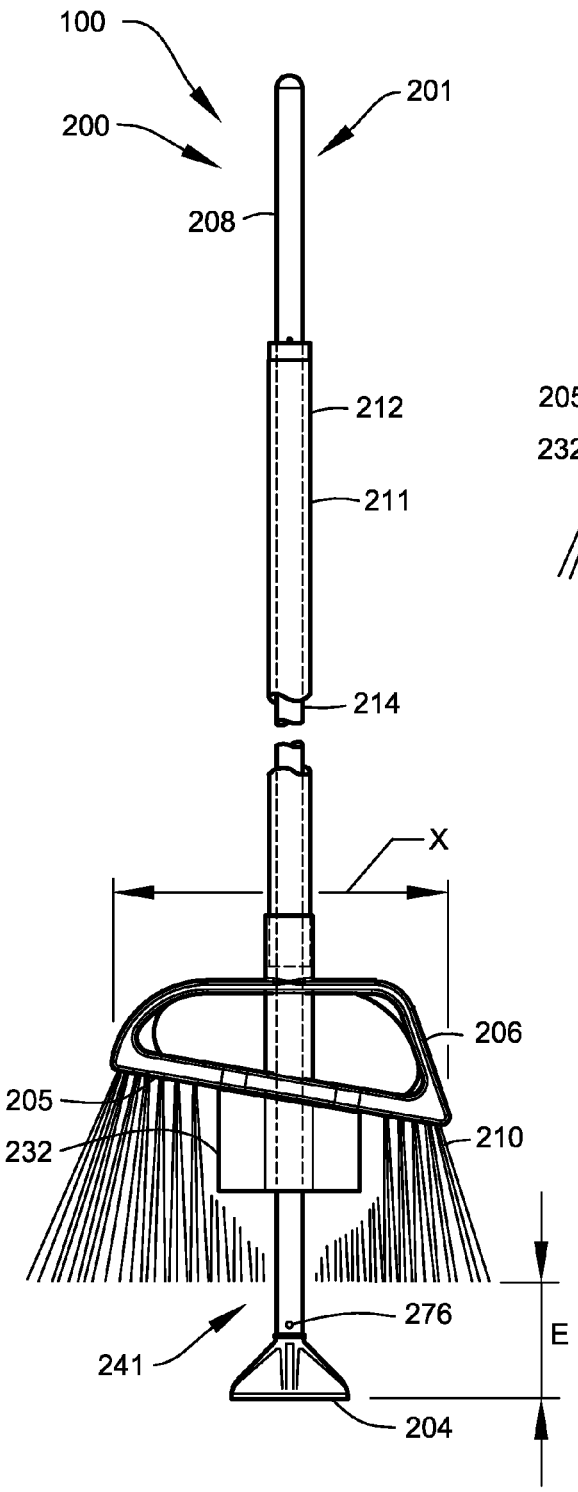
FIG. 13 shows a front view of the enhanced broom sweeper of the enhanced sweeping systems, according to another preferred embodiment of the present invention.
Figure 13B:
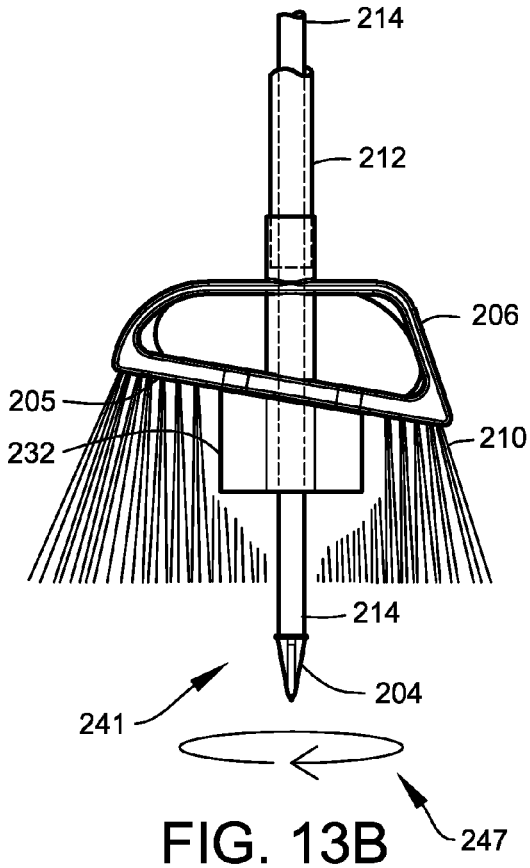
Figure 13C:
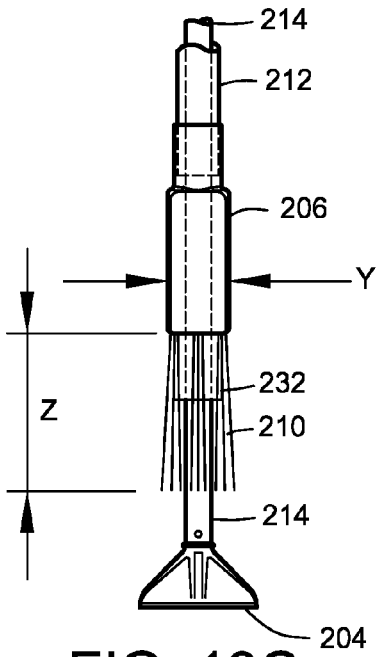
Figure 14A:
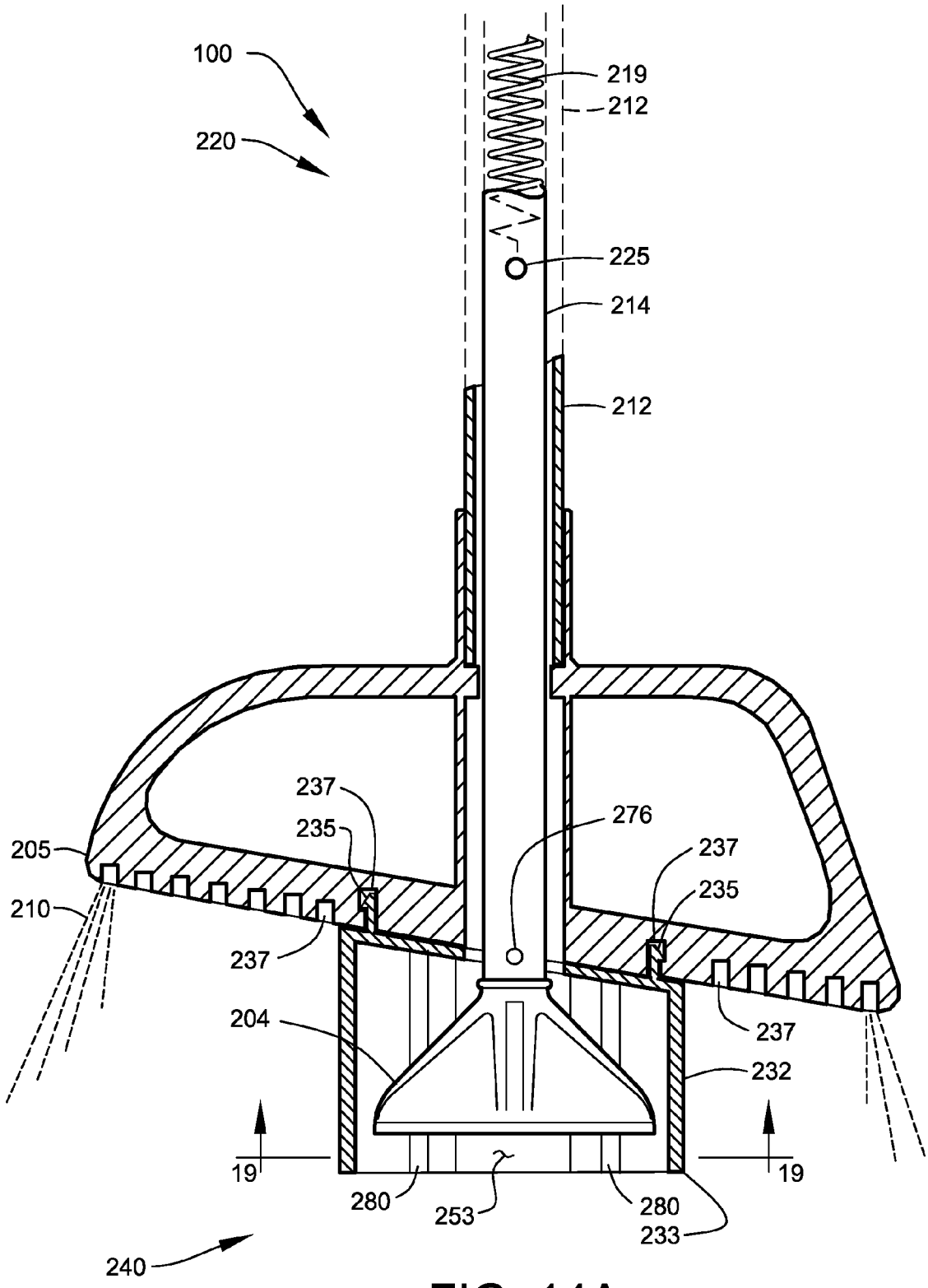
FIG. 14A shows the lower longitudinal section view of another enhanced broom sweeper of the enhanced sweeping systems, according to the preferred embodiment of FIG. 13.

FIG. 13 shows a front view of the enhanced broom sweeper 201 of the enhanced sweeping systems 100, according to another preferred embodiment 200 of the present invention. FIG. 14A shows the lower longitudinal section view of enhanced broom sweeper 201 of the enhanced sweeping systems 100, according to the preferred embodiment 200 of FIG.

Figure 14B:
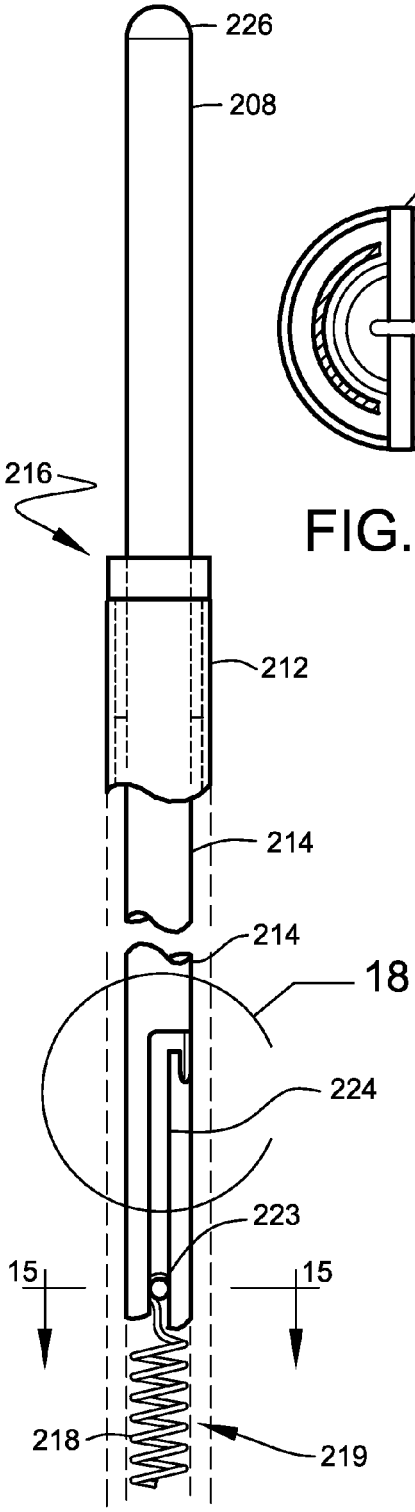
FIG. 14B shows the upper longitudinal section view of the enhanced broom sweeper, according to the preferred embodiment of FIG. 13.

13. FIG. 14B shows the upper longitudinal section view of the enhanced broom sweeper 201, according to the preferred embodiment 200 of FIG. 13.

Enhanced broom sweeper 201 preferably operates similarly to the above described embodiment of FIG. 1, with the major exceptions being an arrangement utilizing a round, rotation-blocker inner-tubular shaft 214 arrangement in combination with a bayonet lock mechanism to lock rotation of the inner-tubular shaft 214 (as opposed to a hexagonal, non-round, rotation-blocker rod arrangement), with respect to an outer handle sleeve 212, and, further comprising at least one removably coupled scraper 204 to such inner-tubular shaft 214, and angular geometry of the broom head 206, as shown.

Enhanced broom sweeper 201 preferably comprises outer handle sleeve 212 (at least embodying herein at least one bristle holder handle structured and arranged to assist user-sweeping with such at least one bristle holder), preferably comprising a hollow cylinder structured and arranged to allow insertion and movement of inner-tubular shaft 214 within such outer handle sleeve 212, as shown. Outer handle sleeve 212 preferably extends perpendicularly from broom head 206 in an about opposed direction from bristles 210, and assists sweeping by at least providing a broom bristle handle, as shown. This arrangement at least embodies herein wherein such at least one bristle holder handle extends perpendicularly from such at least one bristle holder in an about opposed direction from such plurality of bristles. Outer handle sleeve 212 preferably comprises aluminum, preferably aluminum 6063. Upon reading this specification, those with ordinary skill in the art will now appreciate that, under appropriate circumstances, considering such issues as design preference, user preferences, marketing preferences, cost, structural requirements, available materials, technological advances, etc., other bristle/handle arrangements such as, for example, other angular arrangements, hand-held arrangements, multiple bristle portions, etc., may suffice.

Broom head 206 preferably comprises at least one angled support geometry, preferably at least one angled lower support 205, as shown. Broom head 206 preferably comprises a longitudinal span direction (X); a transverse span direction (Y); and a plurality of bristles extending at least in a direction (Z) perpendicular from longitudinal span direction (X) and such transverse span direction (Y), as shown. The above arrangement at least embodies herein wherein such at least one bristle holder comprises a longitudinal span direction (X) and a transverse span direction (Y); and wherein such plurality of bristles extend at least in a direction (Z) perpendicular from such at least one bristle holder longitudinal span direction (X) and such transverse span direction (Y).

Enhanced broom sweeper 201 preferably includes at least one coupled blade-type scraper 204 (at least embodying herein at least one scraper blade structured and arranged to scrape the at least one surface). Blade-type scraper 204 is preferably attached to inner-tubular shaft 214, preferably co-axially with outer handle sleeve 212, preferably deployable to at least one extended position 241 in at least one temporary deployment or, alternately preferably, in at least one locked deployment (further described below and shown). The above arrangement at least embodies herein wherein such at least one scraper blade handle is coaxial with such at least one bristle holder handle. Blade-type scraper 204 preferably is structured and arranged to assist scraping of at least one hard-surface. Blade-type scraper 204 preferably comprises at least one metal blade edge, preferably a sharp metal edge, preferably sharpened steel. Upon reading this specification, those with ordinary skill in the art will now appreciate that, under appropriate circumstances, considering such issues as design preference, user preferences, marketing preferences, cost, structural requirements, available materials, technological advances, etc., other blade-type scraper 204 arrangements such as, for example, plastic, carbon-fiber, stainless steel, aluminum, etc., may suffice.

Blade-type scraper 204 is preferably attached to at least one inner-tubular shaft 214, that preferably acts as a handle extension to assist scraping by at least one user of such enhanced broom sweeper 201 (this arrangement at least embodying herein wherein such at least one scraper blade comprises at least one scraper blade handle structured and arranged to assist scraping with such at least one scraper blade). Alternately preferably, blade-type scraper 204 is removably attachable to inner-tubular shaft 214 preferably using a coupler 276, preferably a depressible pin or alternately preferably another fastener, preferably mounted flush with the exterior perimeter of inner-tubular shaft 214 so as to permit deploying and stowing within such sleeve 232, as shown. Alternately preferably, other devices for scraping, cleaning, squeegee, etc. may be coupled to inner-tubular shaft 214 (see FIG. 20 and FIG. 21, for example).

Enhanced broom sweeper 201 preferably comprises broom bristles 210, as shown. Broom bristles 210 preferably comprise PET (polyethylene terephthalate), are preferably black in color, and are preferably attached to broom head 206 (at least embodying herein at least one bristle holder structured and arranged to hold a plurality of bristles to assist sweeping of the at least one surface), as shown. Preferably, bristles 210 comprise about one-hundred-six ten-bristle-each inserts, preferably each being about 0.9 mm in width each (insert) preferably attached as sloped bristle portions ranging in longitudinal length from about 114 mm (about 4½ inches) on the short side of the preferably angled broom head 206 to about 146 mm (about 5¾ inches) on the longer side of broom head 206, as shown. Upon reading this specification, those with ordinary skill in the art will now appreciate that, under appropriate circumstances, considering such issues as design preference, user preferences, marketing preferences, cost, structural requirements, available materials, technological advances, etc., other bristle arrangements such as, for example, longer or shorter, straight across bristle lengths, etc., may suffice.

Inner-tubular shaft 214 is preferably located at the inside portion of at least one outer handle sleeve 212. Inner-tubular shaft 214 preferably comprises aluminum, preferably aluminum 6063. Inner-tubular shaft 214 preferably comprises at least one upper graspable handle 208, as shown. In use, inner-tubular shaft 214 is preferably movable within outer handle sleeve 212 by a user that preferably holds upper graspable handle 208 with upper hand 142 while preferably holding at least one lower graspable handle 211 with lower hand 143 (as shown previously in FIG. 1) and moves the inner-tubular shaft 214, as shown. Upon reading this specification, those with ordinary skill in the art will now appreciate that, under appropriate circumstances, considering such issues as design preference, user preferences, marketing preferences, cost, structural requirements, available materials, technological advances, etc., other user arrangements such as, for example, single-handed use, grasping other portions of the broom, etc., may suffice.

Inner-tubular shaft 214 preferably utilizes telescopic movement within a co-axial outer handle sleeve 212. Telescopic movement of inner-tubular shaft 214 preferably occurs during at least two positions of such scraper blade, user scraper blade deployment and user scraper blade retraction of blade-type scraper 204, as shown (at least embodying herein wherein such at least one scraper blade comprises at least two positions along such axis). Inner-tubular shaft 214 is preferably round. Blade-type scraper 204 preferably resides inside at least one sleeve 232 when in default-retracted position 240, as shown in FIG. 14A. Preferably, sleeve 232 (at least embodying herein at least one scraper-blade-protector structure adapted to protest against accidental contact with such at least one scraper blade at least when such at least one scraper blade is in such at least one second stowed position) comprises a housing that both protects the blade-type scraper 204 and keeps the broom bristles 210 from being damaged by the scraper blade, as shown.

Sleeve 232 preferably comprises a tubular sleeve, preferably having at least one open end 253 structured and arranged to provide an aperture through which blade-type scraper 204 may be extended through, and retracted fully within the perimeter 233, so as to have at least the blade portion be fully into the interior of sleeve 232, as shown. Such retraction fully into sleeve 232 preferably provides a barrier to assist avoiding accidental contact of blade-type scraper 204, as shown. This arrangement at least embodies herein wherein such at least one scraper-blade-protector structure comprises: at least one sleeve structured and arranged to permit such least one scraper blade to be fully sleeved within the perimeter of such at least one sleeve; wherein, when such least one scraper blade is fully sleeved within the perimeter of such at least one sleeve, accidental contact with such at least one scraper blade is substantially reduced.

Sleeve 232 preferably comprises locking tabs 235 (at least embodying herein at least one coupler to couple such at least one bristle holder to such at least one scraper-blade-protector structure) structured and arranged to lock sleeve 232 into slots 237 on broom head 206, so that sleeve 232 may be attached to the angled lower support 205, preferably permanently, preferably after shipping of such product, or alternately preferably, as a matter of reducing production costs, as shown. Alternately preferably, sleeve 232 may be exchanged for larger sleeve portions should a larger blade-type scraper tool be desired to be attached to such enhanced broom sweeper 201, as shown. Upon reading this specification, those with ordinary skill in the art will now appreciate that, under appropriate circumstances, considering such issues as design preference, user preferences, marketing preferences, cost, structural requirements, available materials, technological advances, etc., other sleeve/housing arrangements for the scraper such as, for example, smaller or larger dimensions, other sleeve geometries, other coupling arrangements, etc., may suffice.

Figure 15:
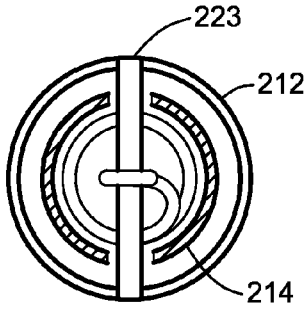
FIG. 15 shows a sectional view, through section 15-15 of FIG. 14B.
Figure 16:
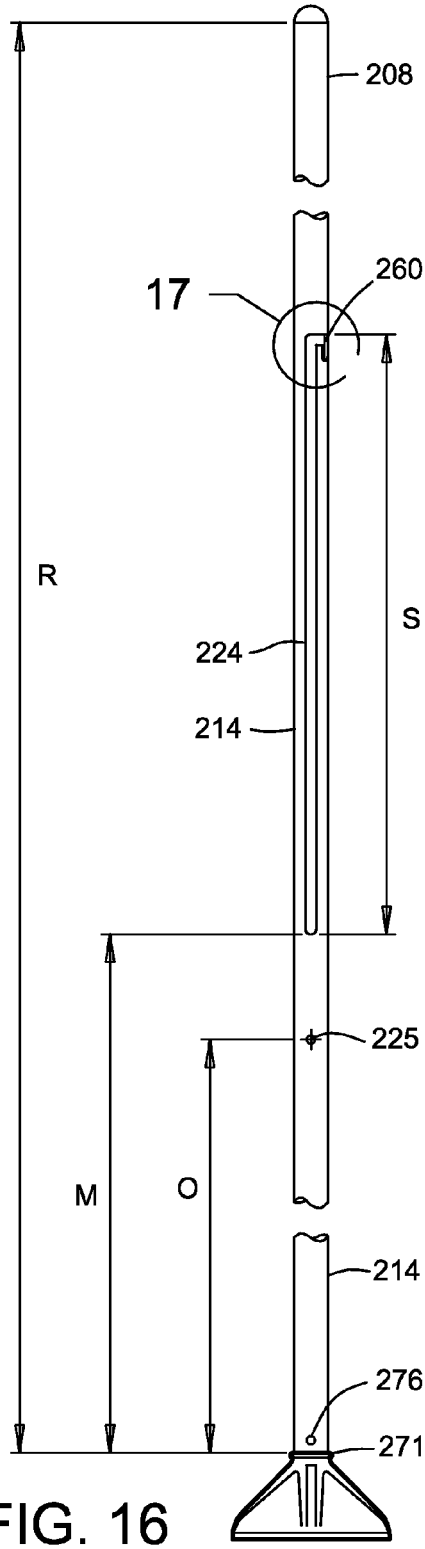
FIG. 16 shows a front view, illustrating the inner-tubular shaft of the enhanced broom sweeper, according to the preferred embodiment of FIG. 13.

FIG. 15 shows a sectional view, through section 15-15 of FIG. 14B. FIG. 16 shows a front view, of the inner-tubular shaft 214 of the enhanced broom sweeper 201, according to the preferred embodiment of FIG. 13.

Enhanced broom sweeper 201 preferably comprises at least an upper portion 216 and lower portion 220, as shown. Upper portion 216 of enhanced broom sweeper 201 preferably comprises upper graspable handle 208, as shown. Graspable handle 208 is preferably configured to contain a mechanical operator assembly adapted to deploy and retract blade-type scraper 204, as shown and described herein (see also FIG. 1). Upper graspable handle 208 preferably comprises at least one upper grip 226, as shown. At least one upper grip 226 is preferably connected to inner-tubular shaft 214 by at least one attachment (shown in FIG. 3 as attachment 158). Upper graspable handle 208 is preferably pushed by upper hand 142, as shown (see FIG. 1), to preferably provide telescopic movement of inner-tubular shaft 214 relative to outer handle sleeve 212. Telescopic movement 215 preferably occurs within handle sleeve 212. Upper graspable handle 208 preferably moves under outer handle sleeve 212 during pushing. The upper portion of inner tubular shaft 214 preferably comprises an elongated hollow tube having an outer diameter slightly smaller than the interior diameter of outer handle sleeve 212, as shown. Inner tubular shaft 214 preferably extends in a downward direction in outer handle sleeve 212 to engage blade-type scraper 204, as shown.

Enhanced broom sweeper 201 preferably houses at least one tension spring system 219. Tension spring system 219 preferably comprises at least one mounting bar 223, at least one tension spring 218, at least one pin 225, at least one inner-tubular shaft 214 and outer handle sleeve 212, as shown. Mounting bar 223 is preferably attached to each side of outer handle sleeve 212 by at least one attacher, preferably as shown (and previously described above in the embodiment of FIG. 1). Upon reading this specification, those with ordinary skill in the art will now appreciate that, under appropriate circumstances, considering such issues as design preference, user preferences, marketing preferences, cost, structural requirements, available materials, technological advances, etc., other spring arrangements such as, for example, multiple springs, compressive springs, other tensioned materials, no spring, etc., may suffice.

Inner tubular shaft 214 is preferably adapted to contain tension spring 218, as shown. The lower end of tension spring 218 is preferably fixed to inner tubular shaft 214, as shown. The upper-opposing end of tension spring 218 is preferably fixed to outer handle sleeve 212, as shown, preferably using a mounting bar 223 extending across the inner bore of outer handle sleeve 212 (in orientation generally perpendicular to the longitudinal axis of the handle). To allow inner tubular shaft 214 to translate telescopically within outer handle sleeve 212 without interference from the mounting bar, a pair of slots 224 are preferably formed within opposing sides of inner tubular shaft 214, at the location of mounting bar 223, as shown.

Pin 225 is preferably mounted to inner-tubular shaft 214 by at least one attachment 252. Pin 225 is preferably located about dimension 'O' 446 mm (17.55 inches) from scraper attacher end 271, as shown. Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, variables of tension/compression spring(s) utilized, overall length of the sweeper, etc., may suffice.

Function of tension spring system 219 (at least embodying herein at least one first force assister structured and arranged to assist such at least one scraper blade to move between such at least one first 'working' position and such at least one second 'stowed' position; and, at least embodying herein such at least one first force assister comprises at least one spring tensioner structured and arranged to assist spring-tension positioning of such at least one scraper blade into such at least one scraper-blade-protector structure) is to preferably assist retraction of both inner shaft assembly 229 and blade-type scraper 204 after use, and, assist force-resistant locking/unlocking from the preferred bayonet lock, by a user. The top of tension spring 218 preferably connects to mounting bar 223. The bottom 257 of tension spring 218 preferably attaches to pin 225. Tension spring 218 preferably retracts inner-tubular shaft 214 upward by preferably (tension) pulling pin 225 relative to outer handle sleeve 212, as shown. When upper graspable handle 208 is released, tension spring system 219 preferably retracts of inner-tubular shaft 214. Upon reading this specification, those with ordinary skill in the art will now appreciate that, under appropriate circumstances, considering such issues as design preference, user preferences, marketing preferences, cost, structural requirements, available materials, technological advances, etc., other spring arrangements such as, for example, compression spring, multiple springs, pistons, tension bands, etc., may suffice.

Mounting bar 223 preferably passes through slots 224 of inner-tubular shaft 214. Slots 224 are preferably sized to allow inner shaft assembly 229 full range of motion for retracting and deploying blade-type scraper 204. Full range of motion for inner shaft assembly 229, as shown, preferably ranges from default retracted position 240 to extended position 241 of blade-type scraper 204. Slots 224 preferably permit inner-tubular shaft 214 to move up and down without interference of mounting bar 223.

Preferably, the overall length of outer handle sleeve 212 is about 1000 mm (about 39.37 inches) with a diameter of preferably about 25.4 mm (about 1-inch). Preferably, the overall length 'R' of inner-tubular shaft 214 is about 1396 mm (about 55 inches) with a preferred diameter of about 15.9 mm (about ⅝ inch). Preferably, the length 'S' of slots 224 are about 285 mm (about 11.22 inches) which preferably about equals the length of travel of the inner-tubular shaft 214 within such outer handle sleeve 212 when deploying or stowing scraper 204. Preferably, slots 224 are situate dimension 'M' about 496 mm (about 19.5 inches) from scraper attacher end 271, as shown. Preferably, coupler 276 is situate about 6 mm from scraper attacher end 271. Preferably, coupler 276 has a diameter of about 4 mm.

Upon reading this specification, those with ordinary skill in the art will now appreciate that, under appropriate circumstances, considering such issues as design preference, user preferences, marketing preferences, cost, structural requirements, available materials, technological advances, etc., other enhanced sweeper dimension arrangements such as, for example, a hand-held sweeper, miniature sweeper, dust sweep, etc., may suffice.

Figure 17:
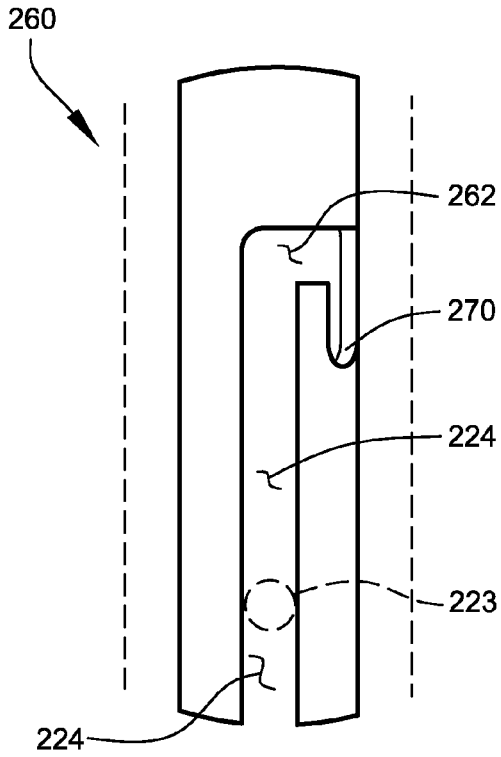
FIG. 17 shows a front view of Detail 17 of FIG. 16.
Figure 18:
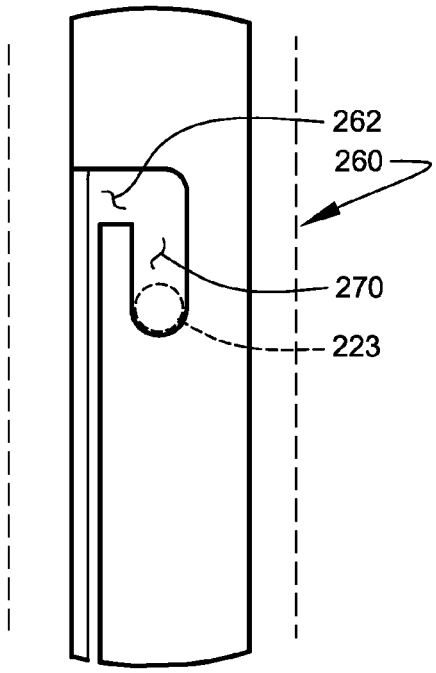
FIG. 18 shows a side view of Detail 18 of FIG. 14B.

FIG. 17 shows a front view of Detail 17 of FIG. 16. FIG. 18 shows a side view of Detail 18 of FIG. 14B.

The upper end of inner tubular shaft 214 preferably engages a user-graspable upper grip 226 preferably adapted to permit the user to manually translate inner tubular shaft 214 up and down within outer handle sleeve 212. The above-described telescopic movement preferably results in the preferred deployment (and retraction) of blade-type scraper 204 from broom head 206.

Preferably, inner tubular shaft 214 comprises at least one positional catch, preferably a bayonet-type lock mechanism 260 (at least embodying herein at least one second force assister structured and arranged to assist such at least one scraper blade to be restrained from moving from such at least one second 'stowed' position to such at least one first 'working' position) comprising at least one first transverse slot 262, preferably perpendicular to such at least one longitudinal slots 224 (see FIG. 17) and at least one parallel longitudinal locking-slot 270 (see FIG. 18) preferably perpendicular to such first transverse slot 262 to at least assist temporarily locking of blade-type scraper 204 blade in the deployed position, as shown Inner tubular shaft 214 is preferably lockable into the deployed extended position 241, preferably by utilizing such bayonet lock mechanism 260, as shown Inner tubular shaft 214 is preferably lockable into about a perpendicular geometry 247 from the sleeve when in the extended position 241 so as to have blade-type scraper 204 be about 90-degrees from the position of such scraper 204 when in the retracted default position 240 housed in such outer handle sleeve 212 (see FIG. 13B).

Deployment preferably occurs in at least one extended (working) position 241, wherein such scraper is extended below broom bristles 210 preferably a distance 'E' about 12.7 mm to about 203 mm (one-half inch to about eight inches) below broom bristles 210; extended (working) position 241 for scraping, preferably is accomplished by pushing inner-tubular shaft 214 down relative to outer handle sleeve 212 so that scraper 204 is below broom bristles 210 (this arrangement at least embodying herein at least one first 'working' position wherein such at least one scraper blade is in at least one working position extending downwardly from such at least one bristle holder and such plurality of bristles) and then preferably (for locking arrangement) by twisting such user-graspable upper grip 226 portion about 90-degrees to rotate (inner-tubular shaft 214) mounting bar 223 into bayonet slot lock portion 265, and then preferably pushing such graspable upper grip 226 downward into parallel longitudinal locking-slot 270, to complete the rotational locking and place blade-type scraper 204 about perpendicular to bristle head, as shown. The above-arrangement at least embodies herein such at least one scraper blade, when in such at least one first (working) position, is rotatable to at least one third (perpendicular scraping) position (Z) about perpendicular to such at least one bristle holder longitudinal span direction (X); and, at least embodies herein such at least one scraper blade, when in such at least one first (working) position, may be locked into such at least one third (perpendicular scraping) position (Z).

Reversing the above-described procedure allows a refracted default position 240 with pull blade-type scraper 204 back up into sleeve 232. The above-arrangement at least embodies herein at least one second (stowed) position wherein such at least one scraper blade is in at least one stowed position extending downwardly from such at least one bristle holder). Further, the above-described arrangement at least embodies herein wherein such co-axial at least one bristle holder handle and such at least one scraper blade handle are structured and arranged to assist movement of such at least one scraper blade between such at least one first (working) position and such at least one second (stowed) position.

Retracted default position 240 is the preferred natural state of the blade-type scraper 204, and permits use of at least the bottoms of broom bristles 210 to be used for sweeping, as shown. The above-arrangement at least embodies herein wherein such at least one second (stowed) position permits use of the bristle bottoms for sweeping. Upon reading this specification, those with ordinary skill in the art will now appreciate that, under appropriate circumstances, considering such issues as design preference, user preferences, marketing preferences, cost, structural requirements, available materials, technological advances, etc., other bayonet arrangements such as, for example, locking by pushing such graspable upper grip 226 upward into an upward slot arrangement, utilizing multiple offset slots arrangements, etc., may suffice.

Retracted default position 240 is preferably assisted by tension spring 218 preferably pulling inner-tubular shaft 214 up relative to outer handle sleeve 212 after twisting such user-graspable upper grip 226 portion to rotate mounting bar 223 out of bayonet slot lock portion 265. Preferably, at least one second lock mechanism, preferably a friction lock, preferably a friction-assister 280 (see below) is positioned so as to assist locking scraper 204 in sleeve 232 (at least embodying at least one stowed-scraper lock element structured and arranged to assist locking such at least one scraper blade in such at least one second (stowed) position).

Figure 19:
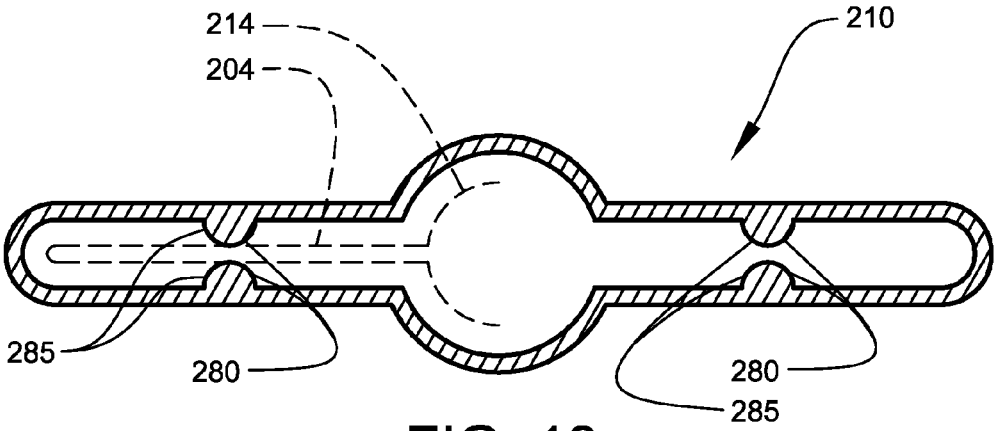
FIG. 19 shows a section view through section 19-19 of FIG. 14A.

FIG. 19 shows a section view through section 19-19 of FIG. 14A. Sleeve 232 preferably comprises at least one friction-assister 280 to friction-assist-hold such blade-type scraper 204 in sleeve 232, as shown. Friction-assister 280 preferably comprises at least one set of raised-rib portions 285, preferably two pair of raised-rib portions 285, preferably mirrored to each other, preferably at least one pair placed on each side of sleeve 232, as shown. Preferably, each raised-rib portion 285 (at least embodying herein wherein such at least one friction-assistor comprises at least one pair of mirrored rib portions, situate inside such perimeter of such at least one sleeve, structured and arranged to friction contact such at least one scraper blade when such at least one scraper blade is fully sleeved in such at least one sleeve) is preferably structured and arranged to produce enough of a friction surface against blade-type scraper 204 to assist preventing unwanted extension of such blade-type scraper 204 from sleeve 232, particularly during normal sweeping use of the broom. Preferably, friction-assister 280 (at least embodying herein wherein such at least one second force assister comprises at least one friction-resistance restrainer structured and arranged to friction-resistance restrain such at least one scraper blade from moving from such at least one second (stowed) position to such at least one first (working) position) comprises molded rubber, or alternately preferably plastic to match the sleeve 232 material. Upon reading this specification, those with ordinary skill in the art will now appreciate that, under appropriate circumstances, considering such issues as design preference, user preferences, marketing preferences, cost, structural requirements, available materials, technological advances, etc., other friction-assist arrangements such as, for example, flexible rubber, friction materials, etc., may suffice.

Figure 20:
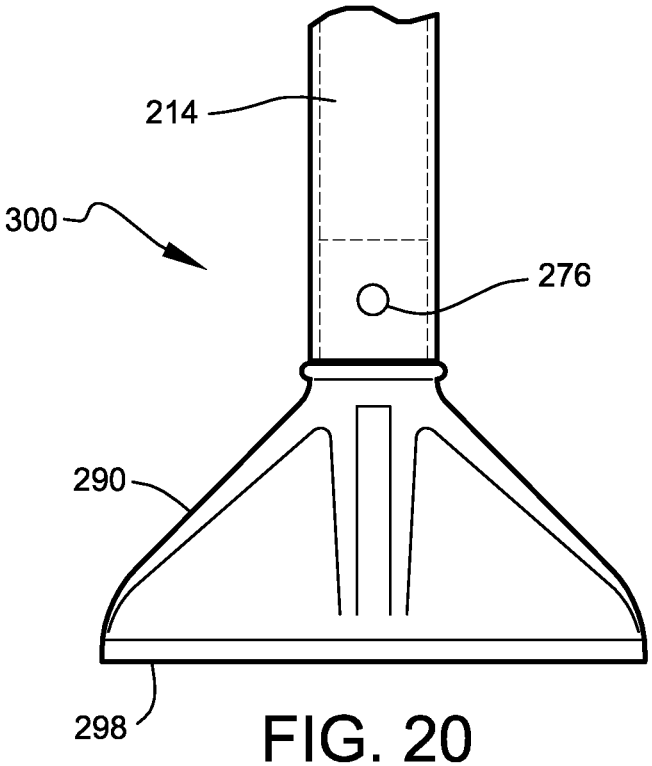
FIG. 20 shows a front view of an alternately preferred inner tubular shaft attachment, illustrating a squeegee scraper, according to another preferred embodiment of the present invention.
Figure 21:
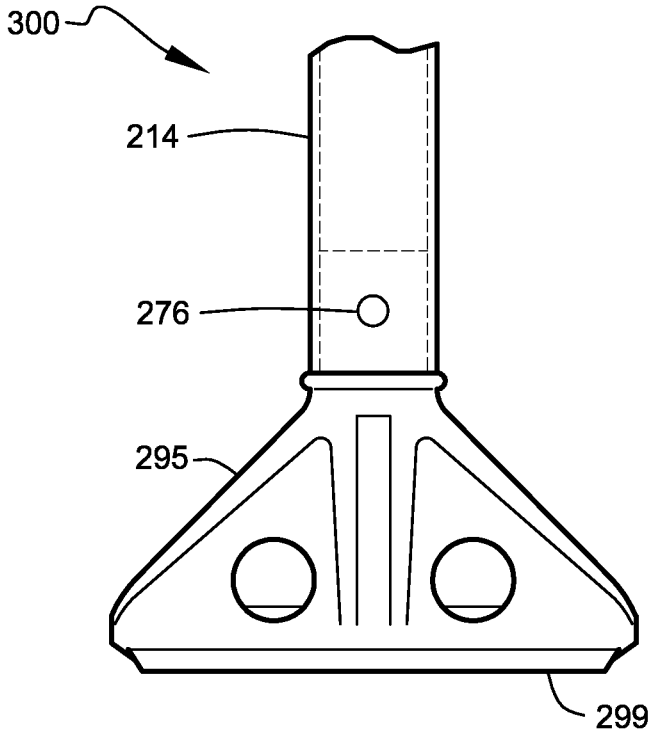
FIG. 21 shows a front view of the alternately preferred inner tubular shaft attachment, illustrating a removable-blade scraper, according to another preferred embodiment of the present invention.

FIG. 20 shows a front view of an alternately preferred inner tubular shaft attachment 300 illustrating a squeegee scraper 290, according to another preferred embodiment of the present invention. FIG. 21 shows a front view of an alternately preferred inner tubular shaft attachment 300, illustrating a removable-blade scraper 295, according to another preferred embodiment of the present invention. Alternately preferred inner tubular shaft attachment 300 preferably provides for a squeegee scraper 290 (at least embodying herein wherein such at least one additional attachment comprises at least one squeegee) comprising a squeegee rubber blade portion 298, to be either replaceable or interchangeable with blade-type scraper 204, as shown. Further, preferably, an alternately preferred inner tubular shaft attachment 300 preferably provides for removable-blade scraper 295 (at least embodying herein wherein such at least one scraper blade is removably attachable to such at least one scraper blade handle), attached to inner tubular shaft 214, to be either replaceable or interchangeable with other attachments, as shown (this arrangement at least embodying herein wherein such at least one scraper blade handle is structured and arranged to couple with and operate at least one additional attachment usable with at least a scraping motion). Removable-blade scraper 295 preferably provides for a scraper having a removable replaceable blade portion 299, as shown.

Preferably, an alternately preferred inner tubular shaft attachment 300 preferably provides for the scraper portion attached to inner tubular shaft 214 to be either replaceable or interchangeable, as shown.

In the illustrated preferred embodiment 200, such preferred inner tubular shaft attachment 300 preferably provides for a removable coupler 276, preferably a depressible pin, alternately preferably a spring-loaded pin structured and arranged to allow replaceable or interchangeable scraper-shaped tool portions (able to fit into a respective sleeve 232) to be placed onto inner tubular shaft 214, as shown. Upon reading this specification, those with ordinary skill in the art will now appreciate that, under appropriate circumstances, considering such issues as design preference, user preferences, marketing preferences, cost, structural requirements, available materials, technological advances, etc., other tool portion arrangements such as, for example, grout brush, wire brush, other scraper-shaped tools, etc., may suffice.

Additionally, those with ordinary skill in the art, upon reading this specification, will now appreciate that, under appropriate circumstances, considering such issues as design preference, user preferences, marketing preferences, cost, structural requirements, available materials, technological advances, etc., other enhanced sweeper dimension arrangements such as, for example, a hand-held sweeper, miniature sweeper, dust sweep, etc., may suffice.

Although applicant has described applicant's preferred embodiments of this invention using metric standardized units, such measurements have been provided only for the convenience of the reader and should not be read as controlling or limiting. Instead, the reader should interpret any measurements provided in English standardized units as controlling. Any measurements provided in metric standardized units were merely derived through strict mechanical coding, with all converted values rounded to two decimal places.

Further, although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A broom comprising:

a head;

a scraper;

a handle including an inner cylinder and an outer cylinder mounted in telescopic arrangement for telescopic extension of the inner cylinder relative to the outer cylinder, and a rotation blocker structured and arranged to prevent rotation between the inner cylinder and the outer cylinder when the inner cylinder is in telescopic extension;

the inner cylinder and the outer cylinder each comprise an upper portion and a lower portion;

the head is coupled to the lower portion of the outer cylinder;

the scraper is coupled to the lower portion of the inner cylinder;

telescopic extension of the inner cylinder relative to the outer cylinder imparts longitudinal extension of the scraper relative to the head;

in longitudinal extension of the scraper, the rotation blocker prevents rotation of the scraper relative to the head;

the rotation blocker is formed by the head and is formed within the head;

the handle includes a spring structured and arranged to spring tension the inner cylinder within the outer cylinder;

the spring urges the scraper into a stowed position within the head;

the spring comprises an upper end and an opposed lower end;

a mounting bar extends within the outer cylinder between opposed sides of the outer cylinder;

a pin is mounted in the inner cylinder;

the upper end of the spring is attached to the mounting bar in the outer cylinder, and the lower end of the spring is attached to the pin in the inner cylinder;

a pair of slots are formed in the opposed sides of the inner cylinder; and the slots move over the mounting bar in response to telescopic extension of the inner cylinder relative to the outer cylinder.

2. The system according to claim 1 wherein the rotation blocker comprises a hexagonally-shaped fit for the inner cylinder.

3. The system according to claim 1 wherein the spring comprises one of a torsion spring and a compression spring.

4. The system according to claim 1, wherein the rotation blocker is disposed on an inner portion of the head and includes a hexagonal clearance fit for receiving a hexagonal section of the inner cylinder.

5. The system according to claim 1, further comprising a protective sleeve attached to the head and extending from the head into bristles on the head.

6. A broom comprising:

an outer handle terminating in a bristled head;

a scraper;

an inner tubular shaft operatively coupled to the scraper to impart movement to the scraper between a stowed position and a working position in response to telescopic movement of the shaft between a retracted position and an extended position with respect to the outer handle;

in the stowed position of the scraper, the scraper is parallel to the head;

in the working position of the scraper, the scraper is perpendicular to the head;

bristles on the head;

a protective sleeve attached to the head and within the bristles; and the sleeve includes an aperture which extends through the sleeve and is configured to receive the scraper in the stowed position thereof.

7. The broom according to claim 6, wherein the sleeve is releasably attachable to the head to permit replacement of the sleeve.

8. The broom according to claim 6, wherein the sleeve comprises:

ribs within the aperture of the sleeve; and the ribs provide a frictional surface against the scraper so as to prevent movement of the scraper from the stowed position to the working position.

9. The broom according to claim 6, further comprising:

a spring system biasing the shaft into the stowed position; and the spring system is within the outer handle.

10. The broom according to claim 9, wherein the spring system comprises:

a mounting bar extending within the outer handle between opposed sides of the outer handle;

a pin mounted in the shaft; and a tension spring contained within the shaft and coupled between the mounting bar and the pin.

11. The broom according to claim 10, further comprising:

a pair of slots formed in opposed sides of the shaft; and the slots move over the mounting bar in response to telescopic movement of the shaft between the retracted and extended positions so as to allow the shaft to move telescopically within the outer handle.

12. A broom comprising:

an outer handle terminating in a bristled head;

a scraper;

an inner tubular shaft operatively coupled to the scraper to impart movement to the scraper between a stowed position and a working position in response to telescopic movement of the shaft between a retracted position and an extended position with respect to the outer handle;

a spring system biasing the shaft into the stowed position;

the spring system includes:

a mounting bar extending within the outer handle between opposed sides of the outer handle;

a pin mounted in the shaft;

a tension spring contained within the shaft and coupled between the mounting bar and the pin;

longitudinal slots formed in opposed sides of the shaft;

locking slots extending from the longitudinal slots;

the longitudinal slots move over the mounting bar in response to telescopic movement of the shaft between the retracted and extended positions so as to allow the shaft to move telescopically within the outer handle; and in response to rotating and depressing the shaft with respect to the outer handle, the locking slots receive the mounting bar to lock the shaft in the extended position and to lock the scraper perpendicular to the head.

13. The broom according to claim 12, wherein in the stowed position of the scraper, the scraper is parallel to the head.

14. The broom according to claim 12, wherein the spring system is within the outer handle.

15. The broom according to claim 12, further comprising:

bristles on the head;

a protective sleeve releasably attached to the head and disposed among the bristles;

the sleeve includes an aperture extending through the sleeve and is configured to receive the scraper in the stowed position thereof;

ribs within the aperture of the sleeve; and the ribs provide a frictional surface against the scraper so as to prevent movement of the scraper from the stowed position to the working position.

* * * * *